US005474495A

United States Patent [19]

Geib et al.

[11] Patent Number: 5,474,495

[45] **Date of Patent: * Dec. 12, 1995**

[54] COIN HANDLING DEVICE

[75] Inventors: Joseph J. Geib, Mount Prospect; Juan J. Malave, Chicago; Donald E. Raterman, Deerfield; George A. Rokos, Naperville, all of Ill.

[73] Assignee: Cummins-Allison Corp., Mt. Prospect, Ill.

[ * ] Notice: The portion of the term of this patent subsequent to Dec. 6, 2011, has been disclaimed.

[21] Appl. No.: 325,778

[22] Filed: Oct. 17, 1994

Related U.S. Application Data

[63] Continuation-in-part of Ser. No. 177,908, Jan. 6, 1994, Pat. No. 5,370,575.

[51] Int. Cl.[6] ..... G07D 3/00

[52] U.S. Cl. ..... 453/3; 453/10; 453/11; 453/14

[58] Field of Search ..... 453/3, 6, 10, 49, 453/57, 63, 11, 14, 13

[56] References Cited

U.S. PATENT DOCUMENTS

| | | | |
|---|---|---|---|
| 4,086,928 | 5/1978 | Ristvedt et al. . | |
| 4,098,280 | 7/1978 | Ristvedt et al. . | |
| 4,234,003 | 11/1980 | Ristvedt et al. . | |
| 4,444,212 | 4/1984 | Ristvedt et al. . | |
| 4,506,685 | 3/1985 | Childers et al. . | |
| 4,531,531 | 7/1985 | Johnson et al. . | |
| 4,543,969 | 10/1985 | Rasmussen . | |
| 4,549,561 | 10/1985 | Johnson et al. . | |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman . | |
| 4,586,522 | 5/1986 | Taipale et al. . | |
| 4,607,649 | 8/1986 | Taipale et al. . | |
| 4,620,559 | 11/1986 | Childers et al. . | |
| 4,681,128 | 7/1987 | Ristvedt et al. . | |
| 4,731,043 | 3/1988 | Ristvedt et al. . | |
| 4,753,624 | 6/1988 | Adams et al. . | |
| 4,775,353 | 10/1988 | Childers et al. . | |
| 4,775,354 | 10/1988 | Rasmussen et al. . | |
| 4,863,414 | 9/1989 | Ristvedt et al. . | |
| 4,921,463 | 5/1990 | Primdahl et al. . | |
| 4,966,570 | 10/1990 | Ristvedt et al. . | |
| 5,009,627 | 4/1991 | Rasmussen . | |
| 5,011,455 | 4/1991 | Rasmussen . | |
| 5,022,889 | 6/1991 | Ristvedt et al. . | |
| 5,026,320 | 6/1991 | Rasmussen . | |
| 5,066,262 | 11/1991 | Abe | 453/57 |
| 5,098,340 | 3/1992 | Abe | 453/57 |
| 5,106,338 | 4/1992 | Rasmussen et al. . | |
| 5,123,873 | 6/1992 | Rasmussen . | |
| 5,141,443 | 8/1992 | Rasmussen et al. . | |
| 5,197,919 | 3/1993 | Geib et al. . | |

FOREIGN PATENT DOCUMENTS

| | | |
|---|---|---|
| 0077627A2 | 4/1983 | European Pat. Off. . |
| 2012863 | 10/1971 | Germany . |

*Primary Examiner*—Michael S. Huppert
*Assistant Examiner*—Scott L. Lowe
*Attorney, Agent, or Firm*—Arnold, White & Durkee

[57] ABSTRACT

A coin handling device for handling a plurality of coins comprises a coin-driving member having a resilient surface and a stationary coin-guiding member having a coin-guiding surface opposing the resilient surface of the coin-driving member. The coin-guiding surface is positioned generally parallel to the resilient surface and spaced slightly therefrom. The resilient surface of the coin-driving member is constructed and arranged to move the coins along the coin-guiding surface of the coin-guiding member. The coin-guiding member includes lubricant-filled cavities, self-lubricating inserts, or a gall-resistant coating to reduce friction between the coins and the coin-guiding surface of the coin-guiding member.

32 Claims, 16 Drawing Sheets

110
112
118
122
124
126
127
128
129
130
131
132
133
134
135
136
137
138
139
140
141
142
144
146
150
152a
152b
152c
152d
152e
152f
152g
152h
154
154a
156
160
162
7
8
50c
25c
10c
5c
1c
$1
Ta'
Tb'

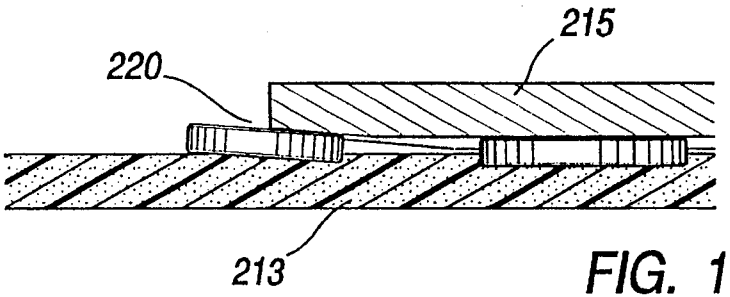
FIG. 11
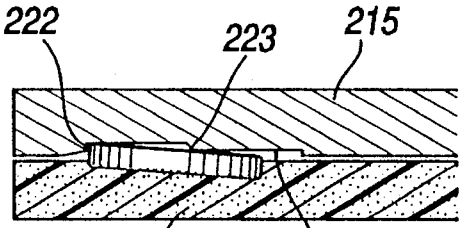
FIG. 12
FIG. 13
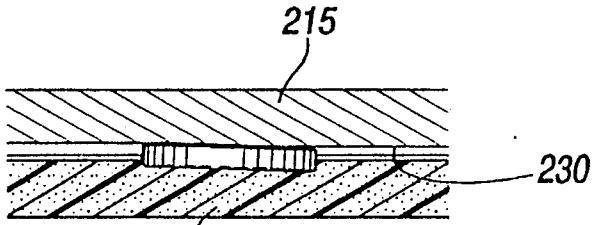
FIG. 14
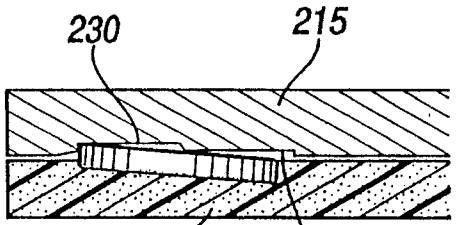
FIG. 15

COIN HANDLING DEVICE

REFERENCE TO RELATED APPLICATION

This application is a continuation-in-part of U.S. patent application Ser. No. 08/177,908, filed Jan. 6, 1994 and allowed, issued on Dec. 6, 1994 as U.S. Pat. No. 5,370,575.

FIELD OF THE INVENTION

The present invention relates generally to coin handling devices for handling coins of mixed denominations. More particularly, the present invention relates to coin handling devices of the type which use a coin-driving member having a resilient surface for moving coins along a metal coin-guiding surface of a stationary coin-guiding member.

BACKGROUND OF THE INVENTION

In coin handling devices of the foregoing type, the coin-guiding member presses coins into the resilient surface of the coin-driving member to maintain positive control over the coins while the coin-driving member moves the coins relative to the stationary coin-guiding member. Such positive control permits the coin handling device to accurately and quickly handle and/or sort coin mixtures which include coin denominations of substantially similar diameters. In addition, the positive control over the coins permits the coin handling device to be quickly stopped by braking of the movement of the coin-driving member when a preselected number of coins of a selected denomination have been ejected from the device. Positive control also permits the coin handling device to be relatively compact yet operate at high speed.

A disadvantage of obtaining positive control of coins by pressing the coins into engagement with the coin-guiding member is that coins composed of such materials as stainless steel, titanium, nickel, and aluminum tend to gall (transfer metal to) the surface of the coin-guiding member due to the friction caused by relative movement between the coins and the coin-guiding member. More specifically, as the coins move over the coin-guiding surface of the coin-guiding member, metal particles from the coins rub off onto the coin-guiding surface. The friction caused by relative movement between the coins and the coin-guiding surface generates heat which, in turn, welds the metal particles from the coins onto the stationary coin-guiding surface. The galled surface of the coin-guiding member can result in mishandling of coins.

SUMMARY OF THE INVENTION

Accordingly, an object of the present invention is to provide a coin handling device which minimizes mishandling by preventing coins from galling the surface of the stationary coin-guiding member.

In accordance with the foregoing object, the present invention provides a coin handling device for handling a plurality of coins. In one particular embodiment, the coin handling device comprises a coin-driving member having a resilient surface and a stationary coin-guiding member having a coin-guiding surface opposing the resilient surface of the coin-driving member. The coin-guiding surface is positioned generally parallel to the resilient surface and spaced slightly therefrom. The resilient surface of the coin-driving member is constructed and arranged to move the coins along the coin-guiding surface of the coin-guiding member. The coin-guiding member includes means for lubricating the coin-guiding surface of the coin-guiding member so as to reduce friction between the coins and the coin-guiding surface of the coin-guiding member. The lubricating means includes lubricant-filled cavities, self-lubricating inserts, or a gall-resistant coating applied to the coin-guiding surface.

BRIEF DESCRIPTION OF THE DRAWINGS

Other objects and advantages of the invention will become apparent upon reading the following detailed description and upon reference to the drawings in which:

FIG. 11 is an enlarged section taken generally along the line 11—11 in FIG. 10, showing the coins in full elevation;

FIG. 12 is an enlarged section taken generally along line 12—12 in FIG. 10, showing the coins in full elevation;

FIG. 13 is an enlarged section taken generally along line 13—13 in FIG. 10, showing the coins in full elevation;

FIG. 14 is an enlarged section taken generally along line 14—14 in FIG. 10, showing the coins in full elevation;

FIG. 15 is an enlarged section taken generally along line 15—15 in FIG. 10, showing the coins in full elevation;

DESCRIPTION OF THE PREFERRED EMBODIMENT

Figure 19:
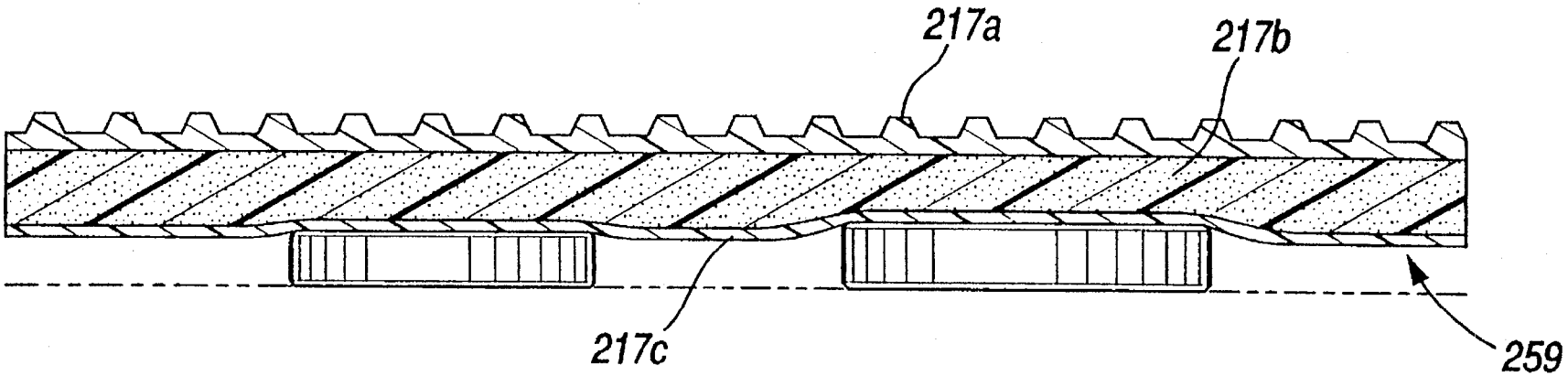
FIG. 19 is an enlarged section of a portion of the drive belt of the rail-type coin sorter in FIG. 9, showing the coins in full elevation.
Figure 20:
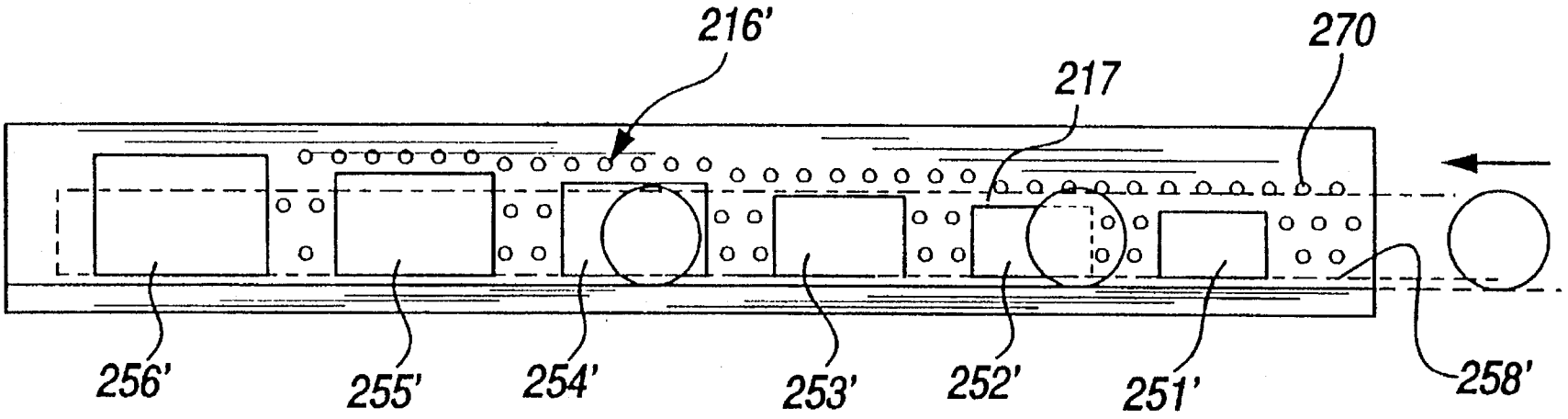
FIG. 20 is an enlarged top plan view of an alternative sorting rail for use in the rail-type device of FIG. 9.
Figure 24:
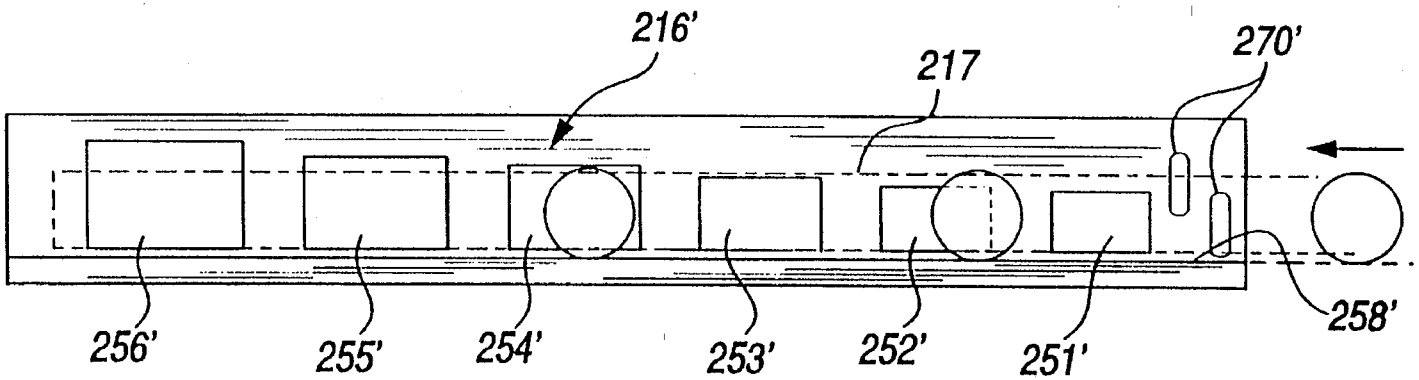
FIG. 24 is an enlarged top plan view of another modified sorting rail for use in the rail-type device of FIG. 9, While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings, FIGS. 1-24 illustrate four types of coin handling devices, including a disc-type coin sorter (FIGS. 1–4 and 21), a disc-to-disc type coin sorter (FIGS. 5–8 and 22), a rail-type coin sorter with exit channels (FIGS. 9–19 and 23), and a modified rail-type coin sorter with exit apertures (FIGS. 20 and 24). Each of these types of coin handling devices uses a coin-driving member having a resilient surface for moving coins along a metal coin-guiding surface of a stationary coin-guiding member. In the disc-type coin sorter, the coin-driving member is a rotating disc and the coin-guiding member is a stationary sorting head. In the disc-to-disc type coin sorter, the coin-driving members include a pair of rotating discs and the coin-guiding members include a stationary queuing head and a stationary sorting disc. In the rail-type coin sorter, the coin-driving member is a drive belt and the coin-guiding member is a stationary sorting rail. In accordance with the present invention, the coin-guiding member(s) in each of the foregoing coin handling devices may be provided with means for lubricating the coin-guiding surface of the coin-guiding member so as to reduce friction between the coins and the coin-guiding surface of the coin-guiding member. The lubricating means may take the form of lubricant-filled cavities, self-lubricating inserts, or a gall-resistant coating applied to the coin-guiding surface.

With respect to the following detailed description, the term "stationary plate" is defined to encompass the stationary sorting head of the disc-type coin sorter, the queuing head and sorting disc of the disc-to-disc type coin sorter, and the sorting rail of the rail-type coin sorter. Furthermore, the term "sorting plate" is defined to encompass the stationary sorting head of the disc-type coin sorter, the sorting disc of the disc-to-disc type coin sorter, and the sorting rail of the rail-type coin sorter.

Figure 1:
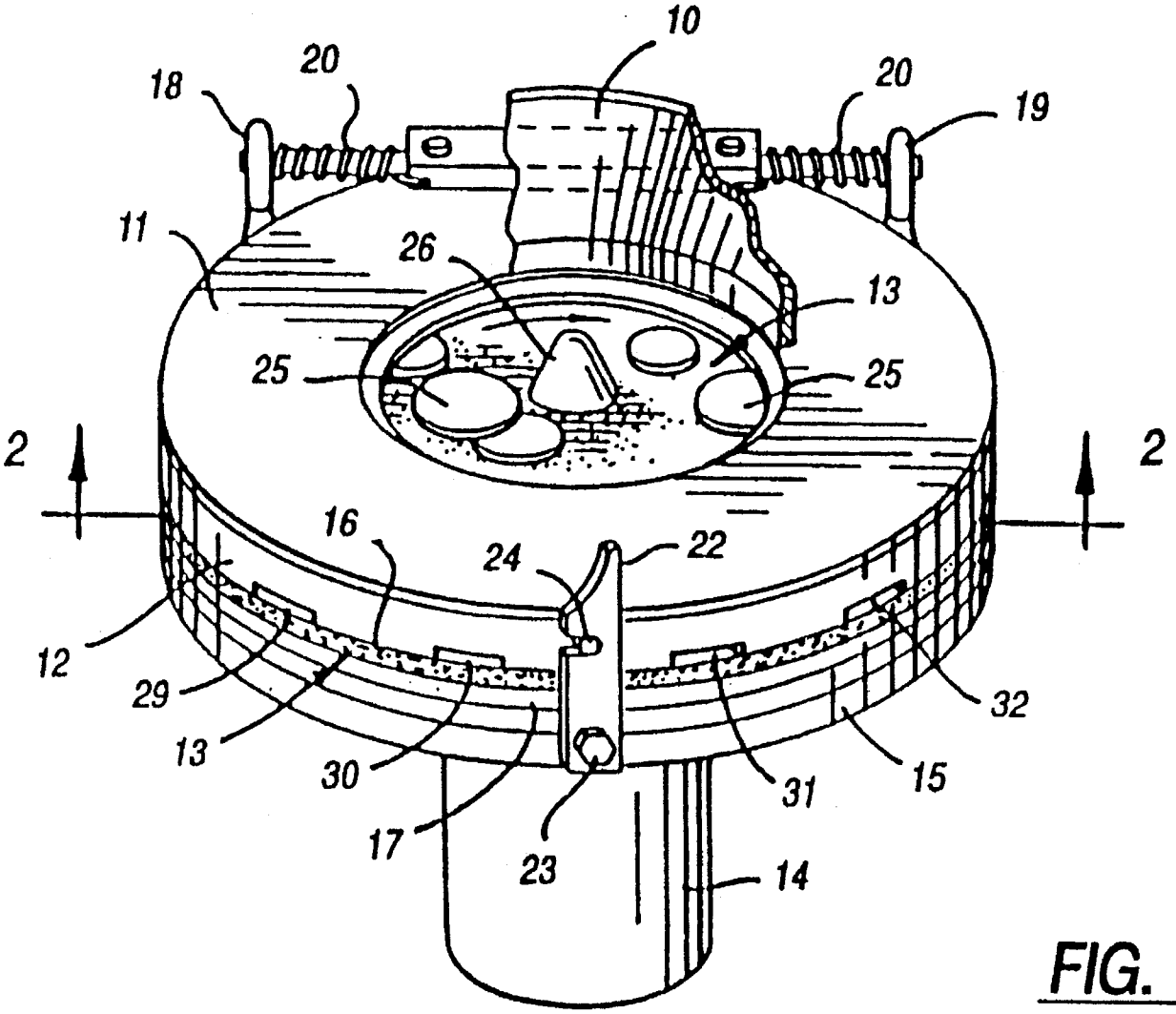
FIG. 1 is perspective view of a disc-type coin sorter embodying the present invention, with a top portion thereof broken away to show internal structure.

Turning first to the disc-type coin sorter of FIG. 1, a hopper 10 receives coins of mixed denominations and feeds them through central openings in a housing 11 and a coin-guiding member in the form of an annular sorting head or guide plate 12 inside or underneath the housing. As the coins pass through these openings, they are deposited on the top surface of a coin-driving member in the form of a rotatable disc 13. This disc 13 is mounted for rotation on a stub shaft (not shown) and driven by an electric motor 14 mounted to a base plate 15. The disc 13 comprises a resilient pad 16 bonded to the top surface of a solid metal disc 17.

The top surface of the resilient pad 16 is preferably spaced from the lower surface of the sorting head 12 by a gap of about 0.005 inches (0.13 mm). The gap is set around the circumference of the sorting head 12 by a three point mounting arrangement including a pair of rear pivots 18, 19 loaded by respective torsion springs 20 which tend to elevate the forward portion of the sorting head. During normal operation, however, the forward portion of the sorting head 12 is held in position by a latch 22 which is pivotally mounted to the frame 15 by a bolt 23. The latch 22 engages a pin 24 secured to the sorting head. For gaining access to the opposing surfaces of the resilient pad 16 and the sorting head, the latch is pivoted to disengage the pin 24, and the forward portion of the sorting head is raised to an upward position (not shown) by the torsion springs 20.

As the disc 13 is rotated, the coins 25 deposited on the top surface thereof tend to slide outwardly over the surface of the pad due to centrifugal force. The coins 25, for example, are initially displaced from the center of the disc 13 by a cone 26, and therefore are subjected to sufficient centrifugal force to overcome their static friction with the upper surface of the disc. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin. As further described below, the coins are sorted into their respective denominations, and the coins for each denomination issue from a respective exit slot, such as the slots 27, 28, 29, 30, 31 and 32 (see FIGS. 1 and 2) for dimes, pennies, nickels, quarters, dollars, and half-dollars, respectively. In general, the coins for any given currency are sorted by the variation in diameter for the various denominations.

Preferably most of the aligning, referencing, sorting, and ejecting operations are performed when the coins are pressed into engagement with the lower surface of the sorting head 12. In other words, the distance between the lower surfaces of the sorting head 12 with the passages conveying the coins and the upper surface of the rotating disc 13 is less than the thickness of the coins being conveyed. As mentioned above, such positive control permits the coin sorter to be quickly stopped by braking the rotation of the disc 13 when a preselected number of coins of a selected denomination have been ejected from the sorter. Positive control also permits the sorter to be relatively compact yet operate at high speed. The positive control, for example, permits the single file stream of coins to be relatively dense, and ensures that each coin in this stream can be directed to a respective exit slot.

Figure 2:
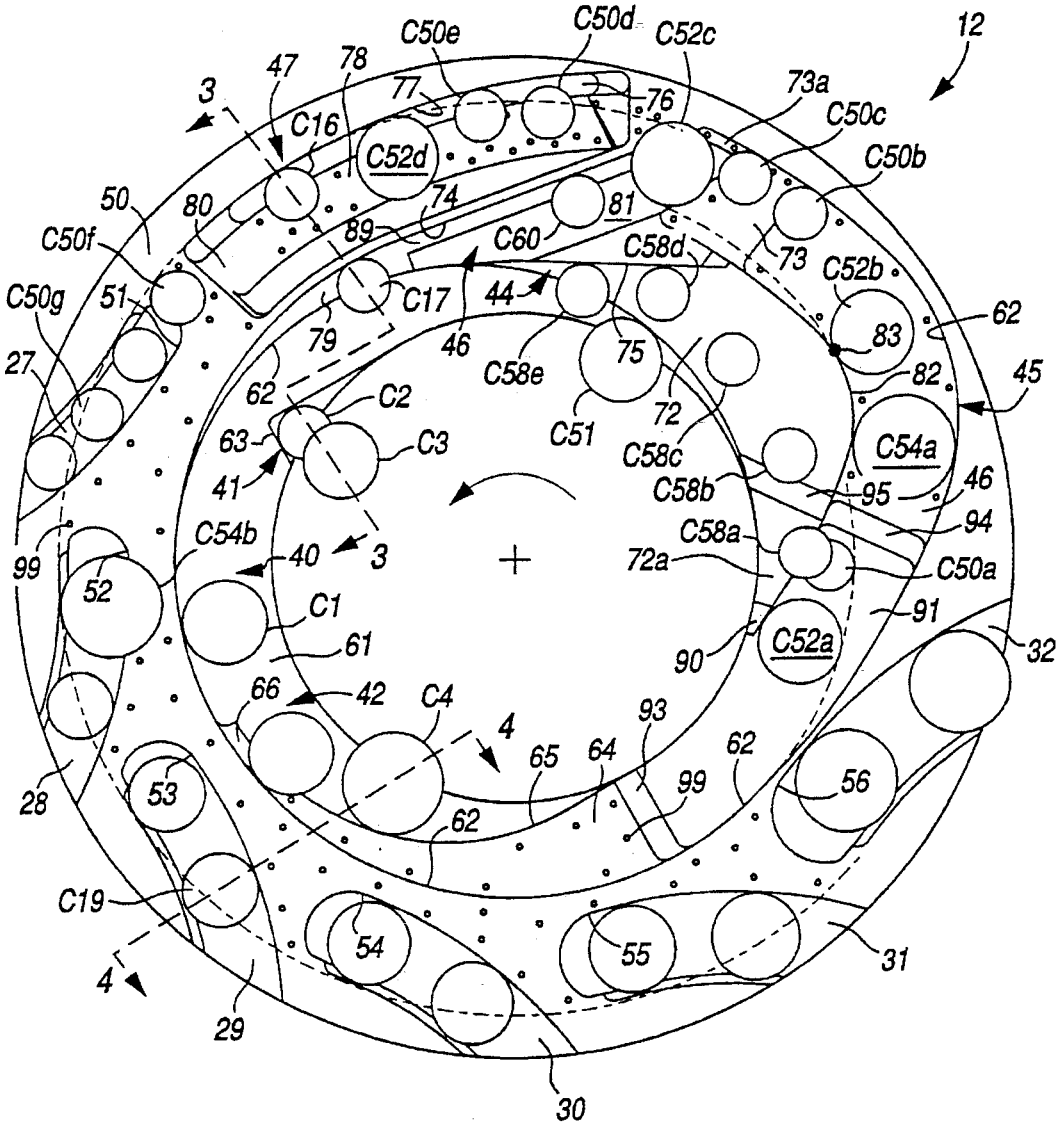
FIG. 2 is an enlarged horizontal section taken generally along line 2—2 in FIG. 1.

Turning now to FIG. 2, there is shown a bottom view of the preferred sorting head 12 including various channels and other means especially designed for high-speed sorting with positive control of the coins, yet avoiding the galling problem. It should be kept in mind that the circulation of the coins, which is clockwise in FIG. 1, appears counterclockwise in FIG. 2 because FIG. 2 is a bottom view. The various means operating upon the circulating coins include an entrance region 40, means 41 for stripping "shingled" coins, means 42 for selecting thick coins, first means 44 for recirculating coins, first referencing means 45 including means 46 for recirculating coins, second referencing means 47, and the exit means 27, 28, 29, 30, 31 and 32 for six different coin denominations, such as dimes, pennies, nickels, quarters, dollars and half-dollars. The lowermost surface of the sorting head 12 is indicated by the reference numeral 50.

Considering first the entrance region 40, the outwardly moving coins initially enter under a semi-annular region underneath a planar surface 61 formed in the underside of the guide plate or sorting head 12. Coin C1, superimposed on the bottom plan view of the guide plate in FIG. 2 is an example of a coin which has entered the entrance region 40.

Free radial movement of the coins within the entrance region 40 is terminated when they engage a wall 62, though the coins continue to move circumferentially along the wall 62 by the rotational movement of the pad 16, as indicated by the central arrow in the counterclockwise direction in FIG. 2. To prevent the entrance region 40 from becoming blocked by shingled coins, the planar region 61 is provided with an inclined surface 41 forming a wall or step 63 for engaging the upper most coin in a shingled pair. In FIG. 2, for example, an upper coin C2 is shingled over a lower coin C3. As further shown in FIG. 3, movement of the upper coin C2 is limited by the wall 63 so that the upper coin C2 is forced off of the lower coin C3 as the lower coin is moved by the rotating disc 13.

Returning to FIG. 2, the circulating coins in the entrance region 40, such as the coin C1, are next directed to the means 42 for selecting thick coins. This means 42 includes a surface 64 recessed into the sorting head 12 at a depth of 0.070 inches (1.78 mm) from the lowermost surface 50 of the sorting head. Therefore, a step or wall 65 is formed between the surface 61 of the entrance region 40 and the surface 64. The distance between the surface 64 and the upper surface of the disc 13 is therefore about 0.075 inches so that relatively thick coins between the surface 64 and the disc 13 are held by pad pressure. To initially engage such thick coins, an initial portion of the surface 64 is formed with a ramp 66 located adjacent to the wall 62. Therefore, as the disc 13 rotates, thick coins in the entrance region that are next to the wall 62 are engaged by the ramp 66 and thereafter their radial position is fixed by pressure between the disc and the surface 64. Thick coins which fail to initially engage the ramp 66, however, engage the wall 65 and are therefore recirculated back within the central region of the sorting head. This is illustrated, for example, in FIG. 4 for the coin C4. This initial selecting and positioning of the thick coins prevents misaligned thick coins from hindering the flow of coins to the first referencing means 45.

Returning now to FIG. 2, the ramp 66 in the means 42 for selecting the thick coins can also engage a pair or stack of thin coins. Such a stack or pair of thin coins will be carried under pad pressure between the surface 64 and the rotating disc 13. In the same manner as a thick coin, such a pair of stacked coins will have its radial position fixed and will be carried toward the first referencing means 45. The first means 45 for referencing the coins obtains a single-file stream of coins directed against the outer wall 62 and leading up to a ramp 73.

Coins are introduced into the referencing means 45 by the thinner coins moving radially outward via centrifugal force, or by the thicker coin(s) C52*a* following concentricity via pad pressure. The stacked coins C58*a* and C50*a* are separated at the inner wall 82 such that the lower coin C58*a* is carried against surface 72*a*. The progression of the lower coin C58*a* is depicted by its positions at C58*b*, C58*c*, C58*d*, and C58*e*. More specifically, the lower coin C58 becomes engaged between the rotating disc 13 and the surface 72 in order to carry the lower coin to the first recirculating means 44, where it is recirculated by the wall 75 at positions C58*d* and C58*e*. At the beginning of the wall 82, a ramp 90 is used to recycle coins not fully between the outer and inner walls 62 and 82 and under the sorting head 12. As shown in FIG. 2, no other means is needed to provide a proper introduction of the coins into the referencing means 45.

The referencing means 45 is further recessed over a region 91 of sufficient length to allow the coins C54 of the widest denomination to move to the outer wall 62 by centrifugal force. This allows coins C54 of the widest denomination to move freely into the referencing means 45 toward its outer wall 62 without being pressed between the resilient pad 16 and the sorting head 12 at the ramp 90. The inner wall 82 is preferably constructed to follow the contour of the recess ceiling. The region 91 of the referencing recess 45 is raised into the head 12 by ramps 93 and 94, and the consistent contour at the inner wall 82 is provided by a ramp 95.

The first referencing means 45 is sufficiently deep to allow coins C50 having a lesser thickness to be guided along the outer wall 62 by centrifugal force, but sufficiently shallow to permit coins C52, C54 having a greater thickness to be pressed between the pad 16 and the sorting head 12, so that they are guided along the inner wall 82 as they move through the referencing means 45. The referencing recess 45 includes a section 96 which bends such that coins C52, which are sufficiently thick to be guided by the inner wall 82 but have a width which is less than the width of the referencing recess 45, are carried away from the inner wall 82 from a maximum radial location 83 on the inner wall toward the ramp 73.

This configuration in the sorting head 12 allows the coins of all denominations to converge at a narrow ramped finger 73*a* on the ramp 73, with coins C54 having the largest width being carried between the inner and outer walls via the surface 96 to the ramped finger 73*a* so as to bring the outer edges of all coins to a generally common radial location. By directing the coins C50 radially inward along the latter portion of the outer wall 62, the probability of coins being offset from the outer wall 62 by adjacent coins and being led onto the ramped finger 73*a* is significantly reduced. Any coins C50 which are slightly offset from the outer wall 62 while being led onto the ramp finger 73*a* may be accommodated by moving the edge 51 of exit slot 27 radially inward, enough to increase the width of the slot 27 to capture offset coins C50 but to prevent the capture of coins of the larger denominations. For sorting Dutch coins, the width of the ramp finger 73*a* may be about 0.140 inch. At the terminal end of the ramp 73, the coins become firmly pressed into the pad 16 and are carried forward to the second referencing means 47.

A coin such as the coin C50*c* will be carried forward to the second referencing means 47 so long as a portion of the coin is engaged by the narrow ramped finger 73*a* on the ramp 73. If a coin is not sufficiently close to the wall 62 so as to be engaged by this ramped finger 73*a*, then the coin strikes a wall 74 defined by the second recirculating means 46, and that coin is recirculated back to the entrance region 40.

The first recirculating means 44, the second recirculating means 46 and the second referencing means 47 are defined at successive positions in the sorting head 12. It should be apparent that the first recirculating means 44, as well as the second recirculating means 46, recirculate the coins under positive control of pad pressure. The second referencing means 47 also uses positive control of the coins to align the outer most edge of the coins with a gaging wall 77. For this purpose, the second referencing means 47 includes a surface 76, for example, at 0.110 inches (1.27 mm) from the bottom surface of the sorting head 12, and a ramp 78 which engages the inner edge portions of the coins, such as the coin C50*d*.

Figure 3:
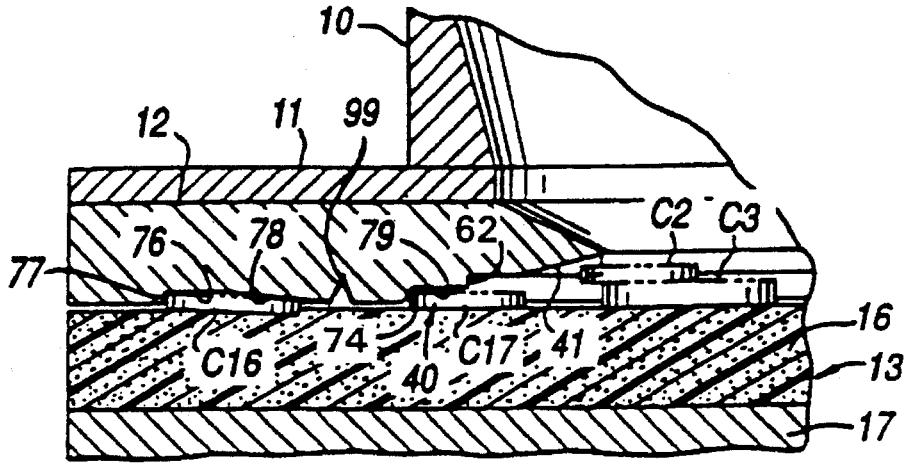
FIG. 3 is an enlarged section taken generally along line 3—3 in FIG. 2, showing the coins in full elevation.

As best shown in FIG. 2, the initial portion of the gaging wall 77 is along a spiral path with respect to the center of the sorting head 12 and the sorting disc 13, so that as the coins are positively driven in the circumferential direction by the rotating disc 13, the outer edges of the coins engage the gaging wall 77 and are forced slightly radially inward to a precise gaging radius, as shown for the coin C16 in FIG. 3. FIG. 3 further shows a coin C17 having been ejected from the second recirculating means 46.

Referring back to FIG. 2, the second referencing means 47 terminates with a slight ramp 80 causing the coins to be firmly pressed into the pad 16 on the rotating disc with their outer most edges aligned with the gaging radius provided by the gaging wall 77. At the terminal end of the ramp 80 the coins are gripped between the guide plate 12 and the resilient pad 16 with the maximum compressive force. This ensures that the coins are held securely in the new radial position determined by the wall 77 of the second referencing means 47.

The sorting head 12 further includes sorting means comprising a series of ejection recesses 27, 28, 29, 30, 31 and 32 spaced circumferentially around the outer periphery of the plate, with the innermost edges of successive slots located progressively farther away from the common radial location of the outer edges of all the coins for receiving and ejecting coins in order of increasing diameter. The width of each ejection recess is slightly larger than the diameter of the coin to be received and ejected by that particular recess, and the surface of the guide plate adjacent the radially outer edge of each ejection recess presses the outer portions of the coins received by that recess into the resilient pad so that the inner edges of those coins are tilted upwardly into the recess. The ejection recesses extend outwardly to the periphery of the guide plate so that the inner edges of these recesses guide the tilted coins outwardly and eventually eject those coins from between the guide plate 12 and the resilient pad 16.

The innermost edges of the ejection recesses are positioned so that the inner edge of a coin of only one particular denomination can enter each recess; the coins of all other remaining denominations extend inwardly beyond the innermost edge of that particular recess so that the inner edges of those coins cannot enter the recess.

For example, the first ejection recess 27 is intended to discharge only dimes, and thus the innermost edge 51 of this recess is located at a radius that is spaced inwardly from the radius of the gaging wall 77 by a distance that is only slightly greater than the diameter of a dime. Consequently, only dimes can enter the recess 27. Because the outer edges of all denominations of coins are located at the same radial position when they leave the second referencing means 47, the inner edges of the pennies, nickels, quarters, dollars and half dollars all extend inwardly beyond the innermost edge of the recess 27, thereby preventing these coins from entering that particular recess.

At recess 28, the inner edges of only pennies are located close enough to the periphery of the sorting head 12 to enter the recess. The inner edges of all the larger coins extend inwardly beyond the innermost edge 52 of the recess 28 so that they remain gripped between the guide plate and the resilient pad. Consequently, all the coins except the pennies continue to be rotated past the recess 28.

Similarly, only nickels enter the ejection recess 29, only the quarters enter the recess 30, only the dollars enter the recess 31, and only the half dollars enter the recess 32.

Because each coin is gripped between the sorting head 12 and the resilient pad 16 throughout its movement through the ejection recess, the coins are under positive control at all times. Thus, any coin can be stopped at any point along the length of its ejection recess, even when the coin is already partially projecting beyond the outer periphery of the guide plate. Consequently, no matter when the rotating disc is stopped (e.g., in response to the counting of a preselected number of coins of a particular denomination), those coins which are already within the various ejection recesses can be retained within the sorting head until the disc is re-started for the next counting operation.

Figure 4:
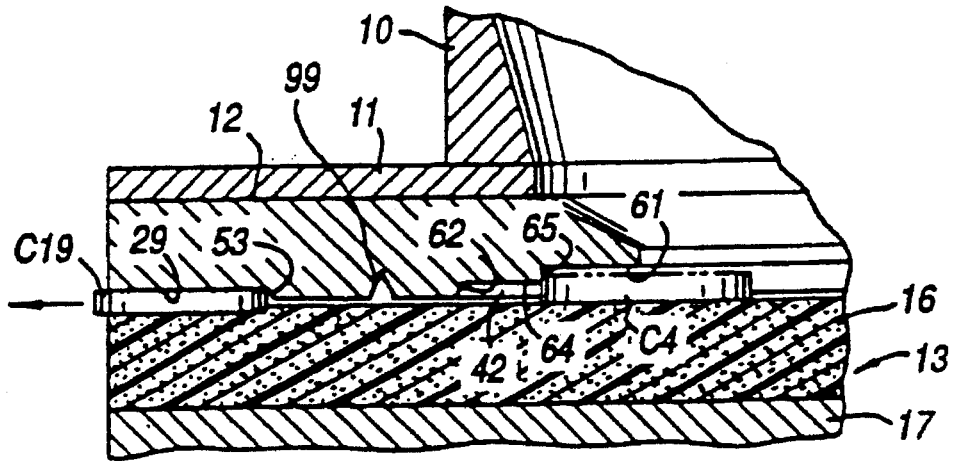
FIG. 4 is an enlarged section taken generally along line 4—4 in FIG. 2, showing in full elevation a nickel registered with an ejection recess.

In order to prevent coins from galling the sorting head 12 in regions where the coins are pressed by the sorting head 12 into the resilient pad 16, the sorting head 12 is provided with gall-resistant means. In an embodiment shown in FIG. 2, selected regions of the sorting head 12 are machined to form a multiplicity of small cavities, dimples, or depressions 99 filled with a solid lubricant. The cavities 99 may be filled with the lubricant by rubbing a solid stick of the lubricant back and forth across the dimpled surfaces so as to fill the cavities 99 with lubricant and, at the same time, coat the surfaces surrounding the cavities 99. The selected regions are generally those regions where the coins are pressed into the pad. With respect to the center of the sorting head 12, the cavities 99 are strategically positioned at radial locations targeting the inner and outer edges of the various coins moving beneath the sorting head 12. It has been found that these inner and outer coin edges precipitate galling more than other portions of the coins. If desired, a uniform or random distribution of a larger number of cavities 99 may be employed in lieu of the strategic positioning of the cavities 99. Although the cavities 99 are illustrated in FIGS. 3 and 4 as having a conical shape, it should be apparent that the cavities 99 may be configured in a variety of other shapes, including but not limiting to cylindrical and rectangular configurations.

As coins slide over the dimpled surfaces of the sorting head, minute amounts of the lubricant are dragged from the cavities onto the passing coins. A portion of this lubricant is then transferred from the coins to the solid surfaces of the sorting head that engage the coins. The end result is a significant reduction in the coefficient of friction between the coins and the sorting head, which in turn minimizes galling of the sorting head. The lubricant is replenished from time to time, preferably at intervals measured by the number of coins processed by the sorter. One way to replenish the lubricant is to simply rub a solid stick of the lubricant back and forth across the dimpled surfaces.

The lubricant should remain solid over the operating temperature range of the sorting head, which can be heated well above room temperature when processing large batches of coins. The lubricant should also be soft enough that it can be removed from the cavities by passing coins, small quantities at a time. In the preferred embodiment, the lubricant is "Door-Easy" lubricant (the DE-25 formula) produced by American Grease Stick Co. of Muskegon, Mich., and having a flash point of approximately 300° F.

Figure 21:
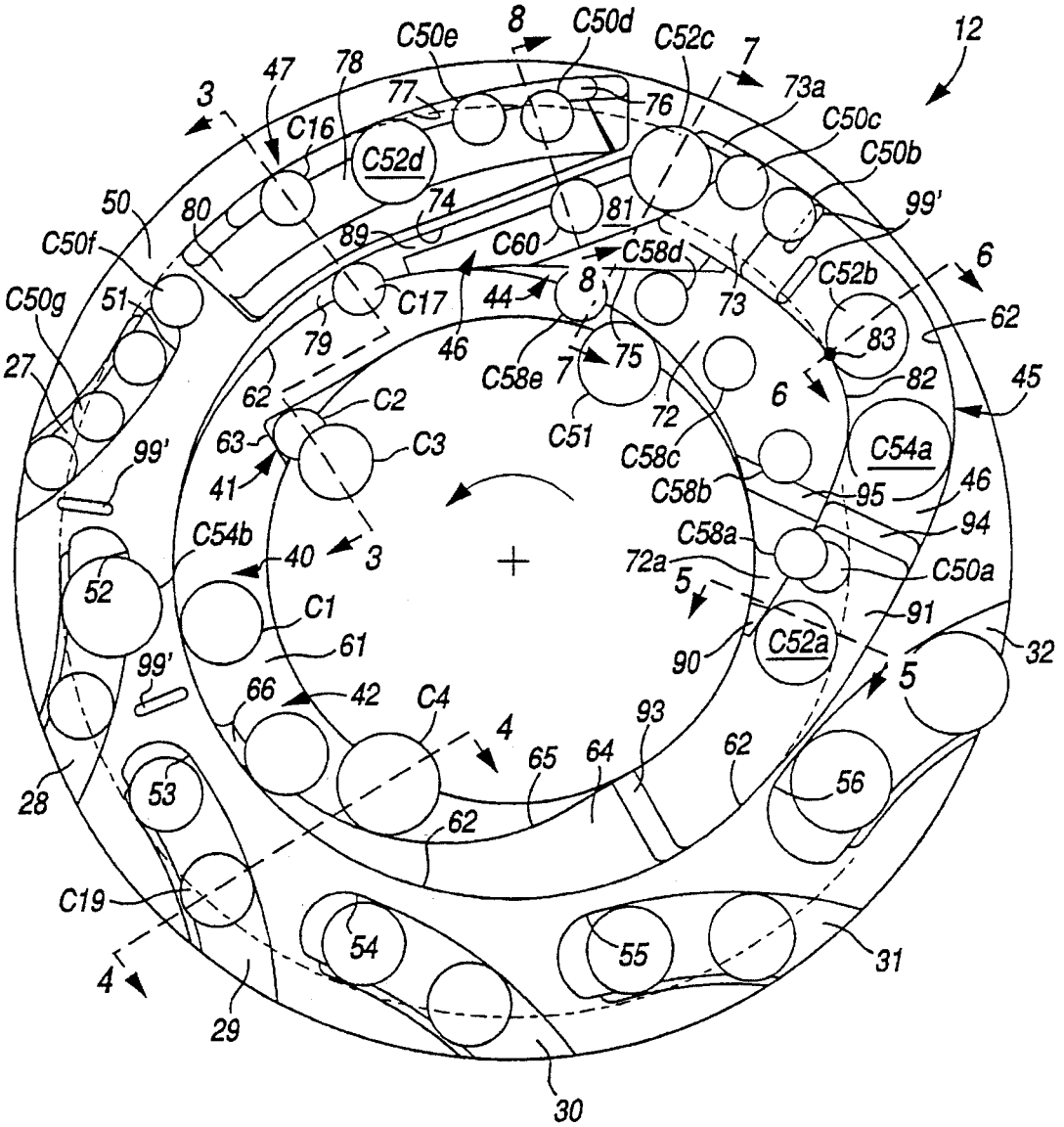
FIG. 21 is a bottom plan view of a modified sorting head for use in the disc-type coin sorter of FIG. 1.

In an alternative embodiment illustrated in FIG. 21, the lubricant-filled cavities 99 are substituted with self-lubricating plugs or inserts 99'. With respect to the center of the sorting head 12, these inserts 99' are elongated in the radial direction and are positioned to target the inner and outer edges of the various coins moving beneath the sorting head 12. The elongated inserts 99' are press-fit into shallow cavities machined into the lower surface of the sorting head 12. The cavities have a depth of approximately 1/16 inch. The inserts 99' should provide gall-resistant, corrosion-resistant, low-wear and low-friction surfaces. Furthermore, the inserts 99' should deliver consistent performance over the operating temperature range of the sorting head. As previously stated, the temperature at the bearing surface (coin-contacting surface) of the inserts 99' can be somewhat higher than room temperature due to the frictional heat generated by the coins moving beneath the sorting head. Moreover, the inserts 99' should exhibit excellent overall dimensional stability combined with a high degree of toughness.

In the preferred embodiment, the inserts 99' are composed of VESPEL® polyimide resin (the SP-22 formula) commercially available from Du Pont Engineering Polymers of Newark, Del. The SP-22 polyimide is a graphite-filled, sintered polyimide resin composed 40 percent by weight of graphite. The graphite in the resin provides the inserts 99' with low wear and friction. In particular, a machined insert composed of SP-22 polyimide has a coefficient of friction of approximately 0.1 at a pressure velocity of 3.5 MPa m/s, a wear rate of approximately 4.2 m/s$\times 10^{-10}$, and a hardness of approximately 5–25 on the Rockwell "E" scale. The inserts 99' may be machined with conventional metalworking equipment applying techniques used in machining brass. Alternatively, the inserts 99' may be manufactured by conventional direct-forming techniques such as molding.

As coins slide over the inserts 99' of the sorting head, minute amounts of graphite rub off the self-lubricating inserts 99' onto the passing coins. A portion of this graphite is then transferred from the coins to the solid surfaces of the sorting head that engage the coins. Thus, the moving coins distribute the graphite across the sorting head. The end result is a significant reduction in the coefficient of friction between the coins and the sorting head, which in turn minimizes galling of the sorting head. It has been found that four inserts 99', positioned as shown in FIG. 21, can sufficiently coat the lower surface of the sorting head 12 to minimize galling. FIG. 21 illustrates two radially-overlapping inserts 99' located in the referencing means 45 just upstream from the ramp 73. A third insert 99' is located just upstream from the ejection recess 28, and a fourth insert 99' is located just upstream from the ejection recess 29. If extensive and long-term use of the coin sorter wears down one or more of the inserts 99', the worn inserts are easily removed from the sorting head and replaced with new inserts.

The lubricant-filled cavities 99 and the elongated self-lubricating inserts 99' are described above in connection with the disc-type coin sorter illustrated in FIGS. 1–4 and 21. The lubricant-filled cavities and self-lubricating inserts, however, may also be employed with other types of coin handling devices, including disc-to-disc type coin sorters and rail-type coin sorters.

Figure 5:
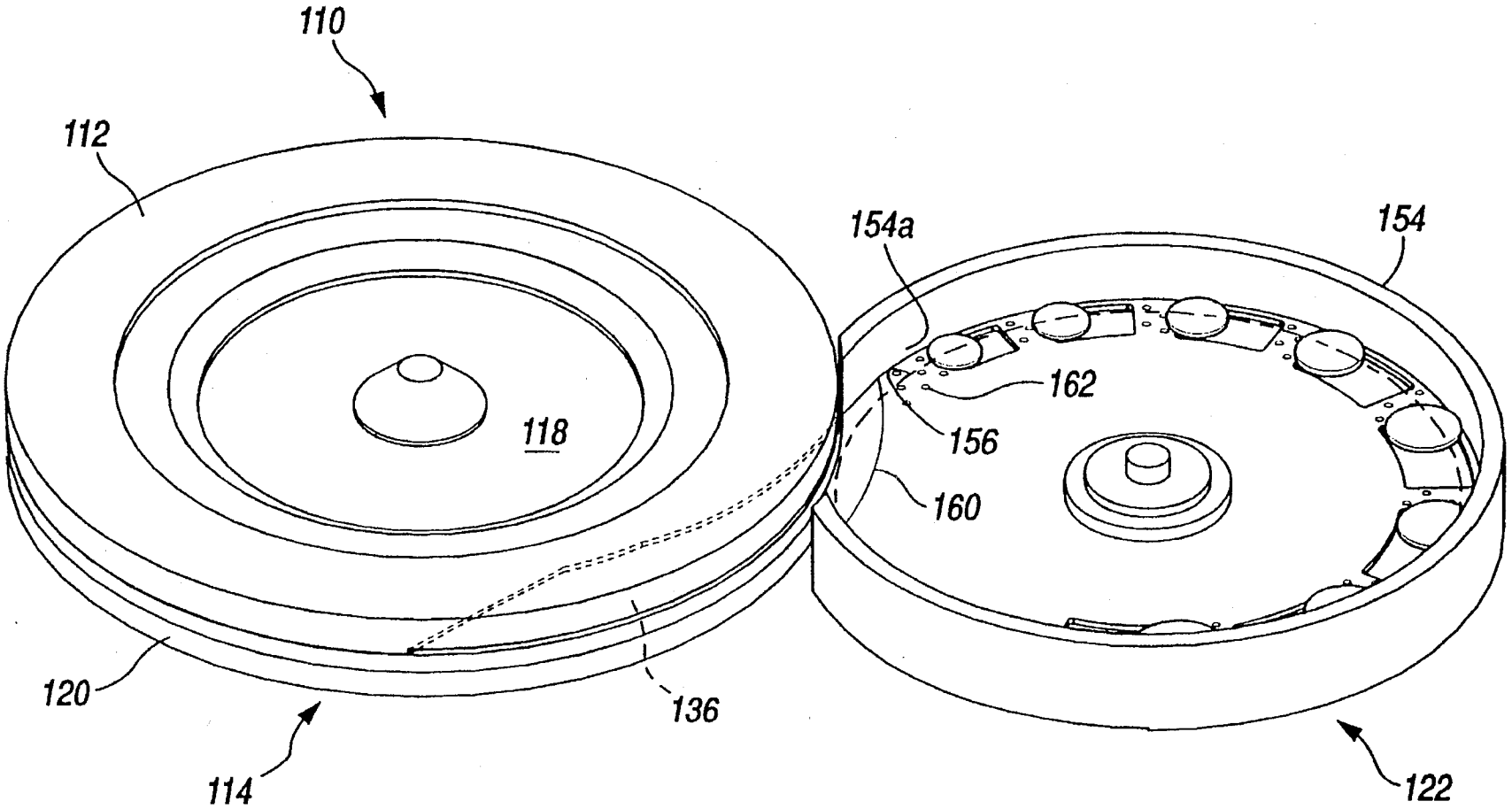
FIG. 5 is perspective view of a disc-to-disc type coin sorter embodying the present invention.

For example, FIG. 5 illustrates a dig-to-disc type coin sorter including a queuing device 110 having a hopper which receives coins of mixed denominations. The hopper feeds the coins through a central feed aperture in a coin-guiding member in the form of an annular queuing head or guide plate 112. As the coins pass through the feed aperture, they are deposited on the top surface of a coin-driving member in the form of a rotatable disc 114. This disc 114 is mounted for rotation on a stub shaft (not shown) driven by an electric motor (not shown). The disc 114 comprises a resilient pad 118, preferably made of a resilient rubber or polymeric material, bonded to the top surface of a solid metal plate 120.

As the disc 114 is rotated (in the counterclockwise direction as viewed in FIG. 6), the coins deposited on the top surface thereof tend to slide outwardly over the surface of the pad 118 due to centrifugal force. As the coins move outwardly, those coins which are lying flat on the pad 118 enter the gap between the pad surface and the queuing head 112 because the underside of the inner periphery of this head 112 is spaced above the pad 118 by a distance which is approximately the same as the thickness of the thickest coin.

Figure 6:
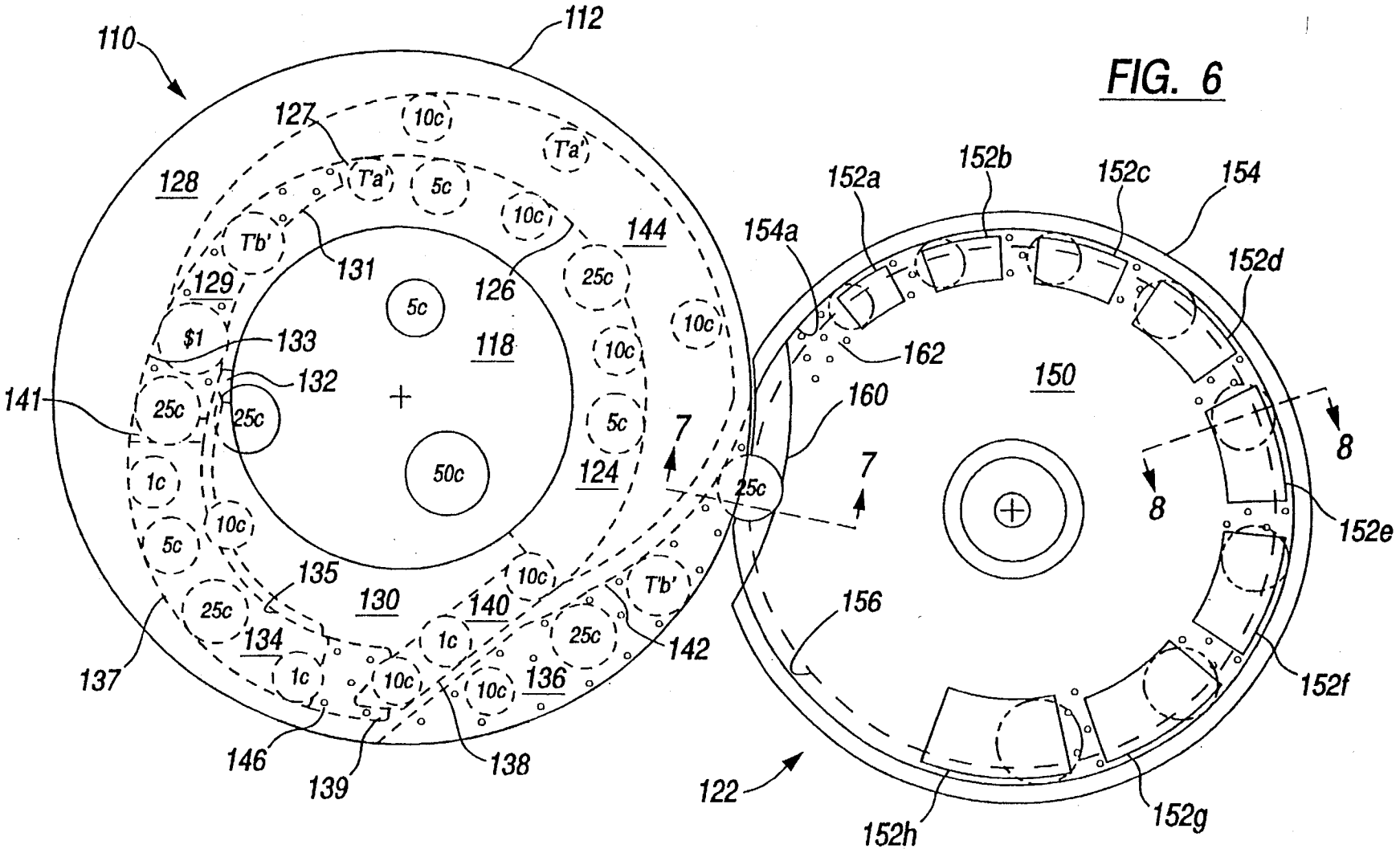
FIG. 6 is a top plan view of the arrangement in FIG. 5.

As can be seen most clearly in FIG. 6, the outwardly moving coins initially enter an annular recess 124 formed in the underside of the queuing head 112 and extending around a major portion of the inner periphery of the queuing head 112. To permit radial movement of coins entering the recess 124, the recess 124 has an upper surface spaced from the top surface of the pad 118 by a distance which is greater than the thickness of the thickest coin. An upstream outer wall 126 of the recess 124 extends downwardly to the lowermost surface 128 of the queuing head 112, which is preferably spaced from the top surface of the pad 118 by a distance (e.g., 0.010 inch) which is significantly less (e.g., 0.010 inch) than the thickness of the thinnest coin. Consequently, the initial radial movement of the coins is terminated when they engage the upstream outer wall 126 of the recess 124, though the coins continue to move circumferentially along the wall 126 by the rotational movement of the pad 118.

A ramp 127 is formed at the downstream end of the outer wall 126. Coins which are engaged to the wall 126 prior to reaching the ramp 127 are moved by the rotating pad 118 into a channel 129. For example, the coin T'a' at approximately the 12 o'clock position in FIG. 6 will be moved by the rotating pad 118 into the channel 129. However, those coins which are still positioned radially inward from the outer wall 126 prior to reaching the ramp 127 engage a recirculation wall 131, which prevents the coins from entering the channel 129. Instead, the coins are moved along the recirculation wall 131 until they reach a ramp 132 formed at the upstream end of a land 130.

The only portion of the central opening of the queuing head 112 which does not open directly into the recess 124 is that sector of the periphery which is occupied by the land 130. The land 130 has a lower surface which is co-planar with or at a slightly higher elevation than the lowermost surface 128 of the queuing head 112. Coins initially deposited on the top surface of the pad 118 via its central feed aperture do not enter the peripheral sector of the queuing head 112 located beneath the land 130 because the spacing between the land 130 and the pad 118 is slightly less than the thickness of the thinnest coin.

When a coin has only partially entered the recess 124 (i.e., does not engage the ramp 127) and moves along the recirculation wall 131, the coin is recirculated. More specifically, an outer portion of the coin engages the ramp 132 on the leading edge of the land 130. For example, a 25 cent coin at approximately the 9 o'clock position in FIG. 6 is illustrated as having engaged the ramp 132. The ramp 132 presses the outer portion of the coin downwardly into the resilient pad 118 and causes the coin to move downstream in a concentric path beneath the inner edge of the land 130 (i.e., inner periphery of the queuing head 112) with the outer portion of the coin extending beneath the land 130. After reaching the downstream end of the land 130, the coin reenters the recess 124 so that the coin can be moved by the rotating pad 118 through the recess 124 and into the channel 129.

To prevent the coins from galling the surface of the land 130 of the queuing head 112 as the outer portion of the coin moves therebeneath, the land 130 is preferably provided with lubricant-filled cavities 146 akin to the cavities 99 in FIG. 2. Like the cavities 99 in FIG. 2, the cavities may have virtually any geometric configuration, including, but not limited to, cylindrical, polygonal, or other closed shape. If desired, the periphery of the closed shape may include both straight lines and curved lines.

Coins which engage the ramp 127 enter the channel 129, defined by the inner wall 131 and an outer wall 133. The outer wall 133 has a constant radius with respect to the center of the disc 114. Since the distance between the upper surface of the channel 129 and the top surface of the rotating pad 118 is only slightly less than the thickness of the thinnest coin, the coins move downstream in a concentric path through the channel 129. To prevent galling of the surface of the channel 129 as the coins move downstream therethrough, the channel 129 is provided with the lubricant-filled cavities 146. While moving downstream, the coins maintain contact with the outer wall 133. At the downstream end of the channel 129, the coins move into a spiral channel 134 via a ramp 141. The distance between the upper surface of the spiral channel 134 and the top surface of the pad 118 is slightly greater than the thickness of the thickest coin, thereby causing the coins to maintain contact with an outer spiral wall 137 of the channel 134 while moving downstream through the channel 134. The spiral channel 134 guides the coins to an exit channel 136. At the downstream end of the outer spiral wall 137, i.e., at the point where the spiral wall 137 reaches its maximum radius, the coins engage a ramp 139 which presses the coins downwardly into the resilient surface of the rotating pad 118. The outer edges of coins which are against the outer wall 137 have a common radial position and are ready for passage into the exit channel 136. Coins whose radially outer edges are not engaged by the ramp 139 engage a wall 138 of a recycling channel 140 which guides such coins back into the entry recess 124 for recirculation.

The spiral channel 134 strips apart most stacked or shingled coins entering the channel 134 from the channel 129. While a pair of stacked or shingled coins are moving through the channel 129, the combined thickness of the stacked or shingled coins is usually great enough to cause the lower coin in that pair to be pressed into the resilient pad 118. As a result, that pair of coins will be rotated concentrically with the disc through the channel 129 and into the channel 134. Because the inner wall 135 of the channel 134 spirals outwardly, the upper coin will eventually engage the upper vertical portion of the inner wall 135, and the lower coin will pass beneath the wall 135 and beneath the land 130. This lower coin will then be rotated concentrically with the disc beneath the land 130 and recirculated back to the entry recess 124 of the queuing head 112. If, however, the combined thickness of the stacked or shingled coins is not great enough to cause the lower coin in the pair to be pressed into the pad 118 (e.g., two very thin foreign coins), the coins are stripped apart in the exit channel 136 as described below.

The exit channel 136 causes all coins which enter the channel 136, regardless of different thicknesses and/or diameters, to exit the channel 136 with a common edge (the inner edges of all coins) aligned at the same radial position so that the opposite (outer) edges of the coins can be used for sorting in the circular sorting device 122. The upper surface of the channel 136 is recessed slightly from the lowermost surface 128 of the queuing head 112 so that the inner wall 142 of the channel 136 forms a coin-guiding wall. This upper surface, however, is close enough to the pad surface to press coins of all denominations into the resilient pad 118. While the rotating pad 118 moves the coins through the exit channel 136, the lubricant-filled cavities 146 prevent the coins from galling the surface of the exit channel 136.

As coins are advanced through the exit channel 136, they follow a path that is concentric with the center of rotation of the disc 114 in FIG. 5 because the coins of all denominations are continuously pressed firmly into the resilient disc surface. Because the coins are securely captured by this pressing engagement, there is no need for an outer wall to contain coins within the exit channel 136. The inner edges of 15 coins of all denominations eventually engage the inner wall 142, which then guides the coins outwardly to the periphery of the disc. As can be seen in FIG. 6, a downstream section of the inner wall 142 of the exit channel 136 forms the final gaging wall for the inner edges of the coins as the coins exit the queuing head 112.

The exit channel 136 strips apart stacked or shingled coins which are not stripped apart by the spiral channel 134. The combined thickness of any pair of stacked or shingled coins is great enough to cause the lower coin in that pair to be pressed into the resilient pad 118. Consequently, that pair of coins will be rotated concentrically with the disc. Because the inner wall 142 of the exit channel 136 spirals outwardly, the upper coin will eventually engage the upper vertical portion of the inner wall 142, and the lower coin will pass beneath the wall 142. This lower coin will be passed into a recirculating channel 144, which functions like the entry recess 124 to guide the coin downstream into the channel 129.

In the preferred embodiment, the queuing device 110 is used to feed the circular sorting device 122 (see FIG. 5). Thus, in FIG. 6 the coins are sorted by passing the coins over a series of apertures formed around the periphery of a coin-guiding member in the form of a stationary sorting plate or disc 150. The apertures **152*a*–152*h* are of progressively increasing radial width so that the small coins are removed before the larger coins. The outboard edges of all the apertures 152*a*–152*h* are spaced slightly away from a cylindrical wall 154 extending around the outer periphery of the disc 150 for guiding the outer edges of the coins as the coins are advanced over successive apertures. The disc surface between the wall 154 and the outer edges of the apertures 152*a*–152*h* provides a continuous support for the outer portions of the coins. The inner portions of the coins are also supported by the disc 150 until each coin reaches its aperture, at which point the inner edge of the coin tilts downwardly and the coin drops through its aperture. Before reaching the aperture 152*a*, the coins are radially moved slightly inward by the wall 154 to insure accurate positioning of the coins after they are transferred from the queuing device 110 to the circular sorting device 122**.

Figure 8:
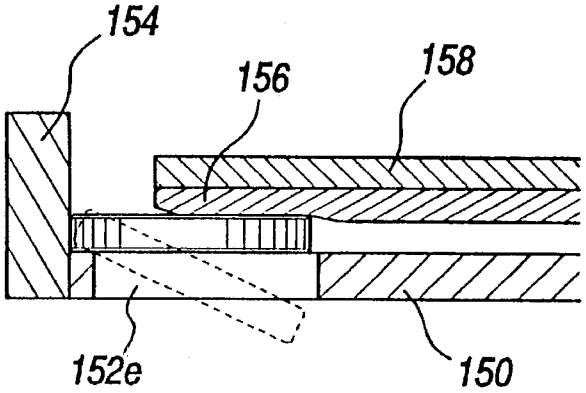
FIG. 8 is an enlarged section taken generally along the line 8—8 in FIG. 6.
Figure 7:
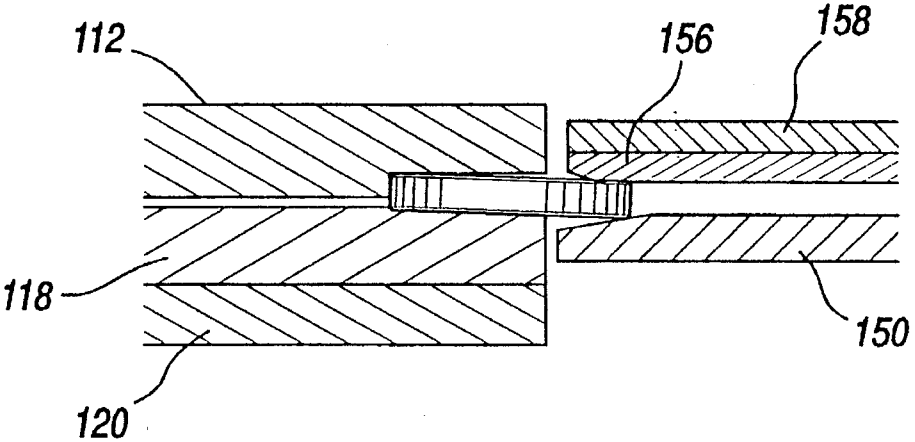
FIG. 7 is an enlarged section taken generally along the line 7—7 in FIG. 6.

To advance the coins along the series of apertures **152*a*–152*h*, the upper surfaces of the coins are engaged by a resilient rubber pad 156 attached to the lower surface of a coin-driving member in the form of a rotating disc 158 (FIGS. 7 and 8). As viewed in FIG. 6, the disc 158 is rotated clockwise. Alternatively, the pad 156 in FIGS. 7 and 8 may be substituted with a resilient rubber ring attached to the outer periphery of the lower surface of the rotating disc 158. The lower surface of the rubber pad 156 is spaced sufficiently close to the upper surface of the disc 150 that the rubber pad 156 presses coins of all denominations, regardless of coin thickness, firmly down against the surface of the disc 150 while advancing the coins concentrically around the peripheral margin of the disc 150. Consequently, when a coin is positioned over the particular aperture 152 through which that coin is to be discharged, the resilient rubber pad 156 presses the coin down through the aperture (FIG. 8**).

To prevent the coins from galling the upper surface of the metal disc 150 as the rotating pad 156 advances the coins around the peripheral margin of the disc 150, the disc 150 is provided with lubricant-filled cavities or holes 162 in the peripheral region of the disc 150. As coins slide over these cavities 162, minute amounts of the lubricant are dragged from the cavities 162 onto the passing coins. A portion of this lubricant is then transferred from the coins to the solid surfaces of the stationary sorting disc 150 that engage the coins. The end result is a significant reduction in the coefficient of friction between the coins and the disc 150, which in turn minimizes galling of the disc 150.

As can be seen in FIG. 6, an arc-shaped section of the stationary disc 150 is cut away at a location adjacent the queuing device 110 to permit a smooth transition between the exit channel 136 and sorting device 122. Because of this cut-away section, coins which are advanced along the exit channel 136 formed by the queuing head 112 are actually engaged by the rubber pad 156 before the coins completely leave the disc 114. As each coin approaches the periphery of the disc 114, the outer portion of the coin begins to project beyond the disc periphery. This projection starts earlier for large-diameter coins than for small-diameter coins. As can be seen in FIG. 7, the portion of a coin that projects beyond the disc 114 eventually overlaps the support surface formed by the stationary sorting disc 150. When a coin overlaps the disc 150, the coin also intercepts the path of the rubber pad 156. The outer portion of the coin is engaged by the rubber pad 156 (FIG. 7).

Each coin is positioned partly within the queuing device 110 and partly within the sorting device 122 for a brief interval before the coin is actually transferred from the queuing device 110 to the sorting device 122. As can be seen in FIG. 6, the coin-guiding inner wall 142 of the exit channel 136 in the queuing head 112 begins to follow an extension of the inner surface **154*a* of the wall 154 at the exit end of the queuing head 112, so that the inboard edges of the coins on the disc 114 (which become the outboard edges of the coins when they are transferred to the disc 150) are smoothly guided by the inner wall 142 of the exit channel 136 and then the inner surface 154*a* of the wall 154 as the coins are transferred from the disc 114 to the disc 150**.

As previously stated, the exit channel 136 has such a depth that the coins of all denominations are pressed firmly down into the resilient pad 118. The coins remain so pressed until they leave the queuing device 110. This firm pressing of the coins into the pad 118 ensures that the coins remain captured during the transfer process, i.e., ensuring that the coins do not fly off the disc 114 by centrifugal force before they are transferred completely to the stationary disc 150 of the sorting device 122.

To facilitate the transfer of coins from the disc 114 to the disc 150, the outer edge portion of the top surface of the disc 150 is tapered at 160 (see FIG. 7). Thus, even though the coins are pressed into the pad 118, the coins do not catch on the edge of the disc 150 during the coin transfer.

Figure 22:
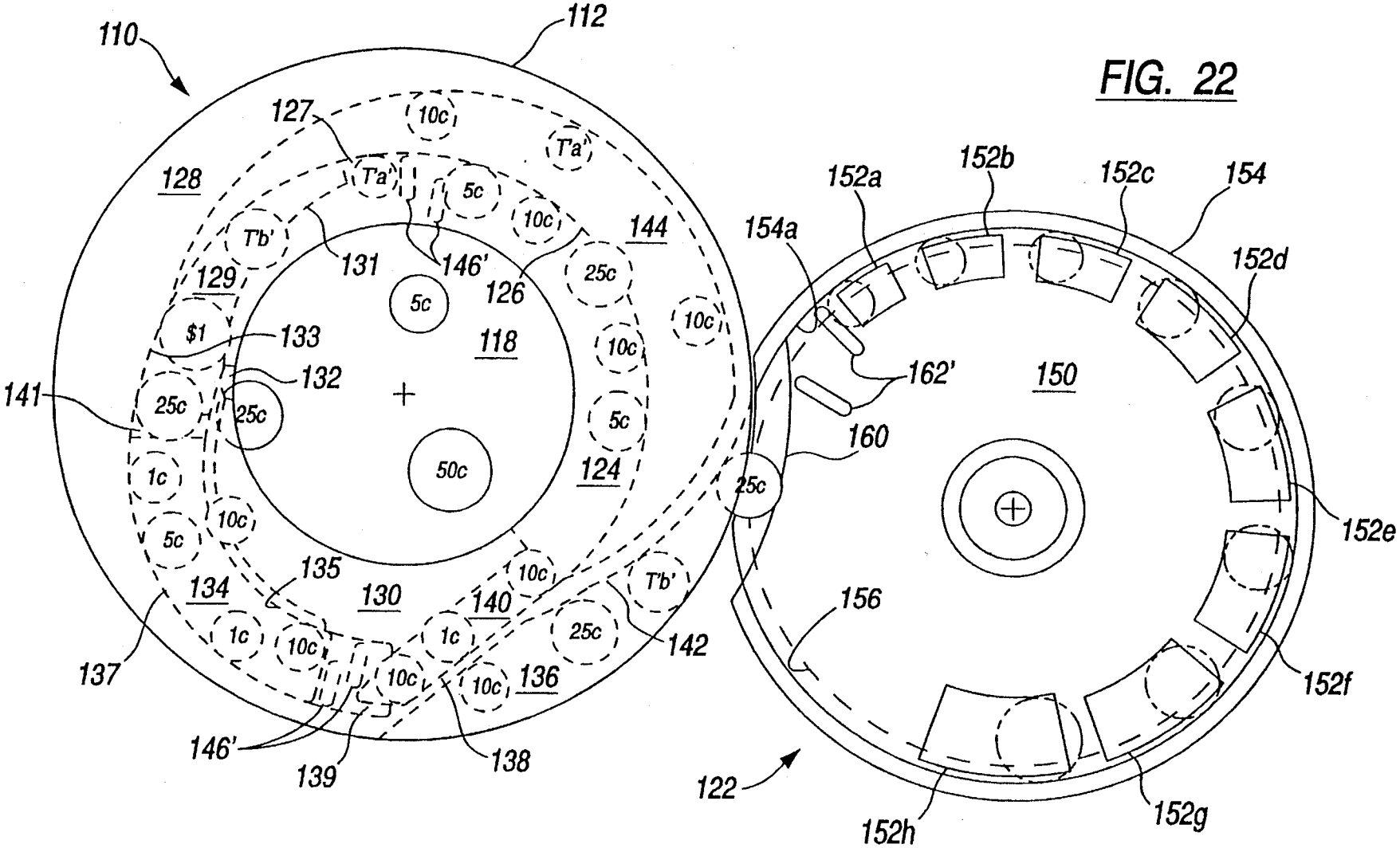
FIG. 22 is a top plan view of a modified disc-to-disc type coin sorter embodying the present invention.
Figure 23:
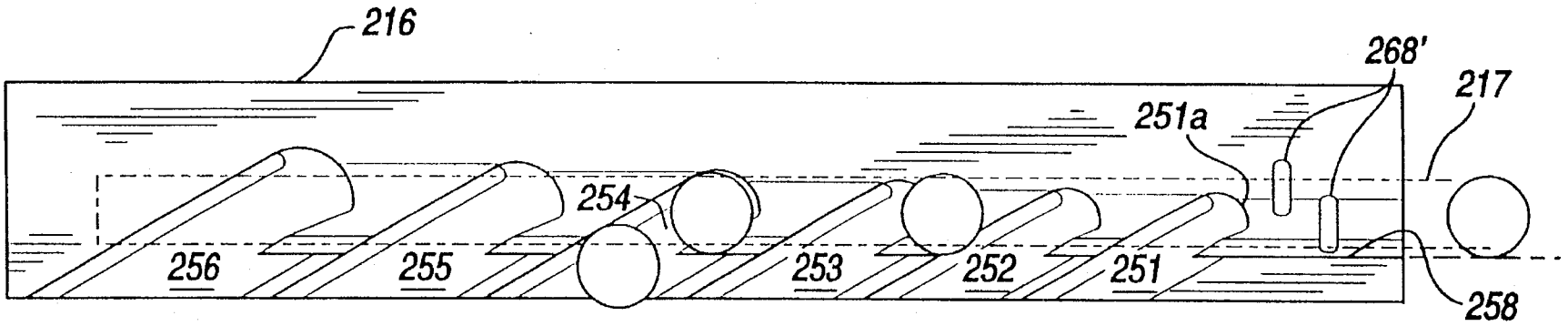
FIG. 23 is an enlarged top plan view of a modified sorting rail for use in the rail-type device of FIG. 9.

In an alternative embodiment illustrated in FIG. 22, the lubricant-filled cavities 146 and 162 are substituted with elongated self-lubricating plugs or inserts 146' and 162' akin to the inserts 99' in FIG. 21. These inserts 146' and 162' are press-fit into shallow cavities machined into the surface of the respective stationary queuing head 112 and the stationary disc. 150. As depicted in FIG. 22, the queuing head 112 preferably contains two radially-overlapping inserts 146' just upstream from the channel 129 and two radially-overlapping inserts 146' just upstream from the exit channel 136. The stationary disc 150 preferably contains two radially-overlapping inserts 162' just upstream from the exit aperture **152*a***. Each radially-overlapping pair of graphite-loaded inserts targets the inner and outer edges of the various coins moving over the inserts.

The embodiments described and illustrated in connection with FIGS. 1–8, 21, and 22 focus on coin handling devices of the type which use a resilient rotating disc and a stationary plate for handling coins of mixed denominations. The present invention, however, may also be employed with coin handling devices of the type which use a stationary sorting rail and a drive belt for moving coins along the sorting rail. One such coin handling device is illustrated in FIGS. 9–19.

Figure 9:
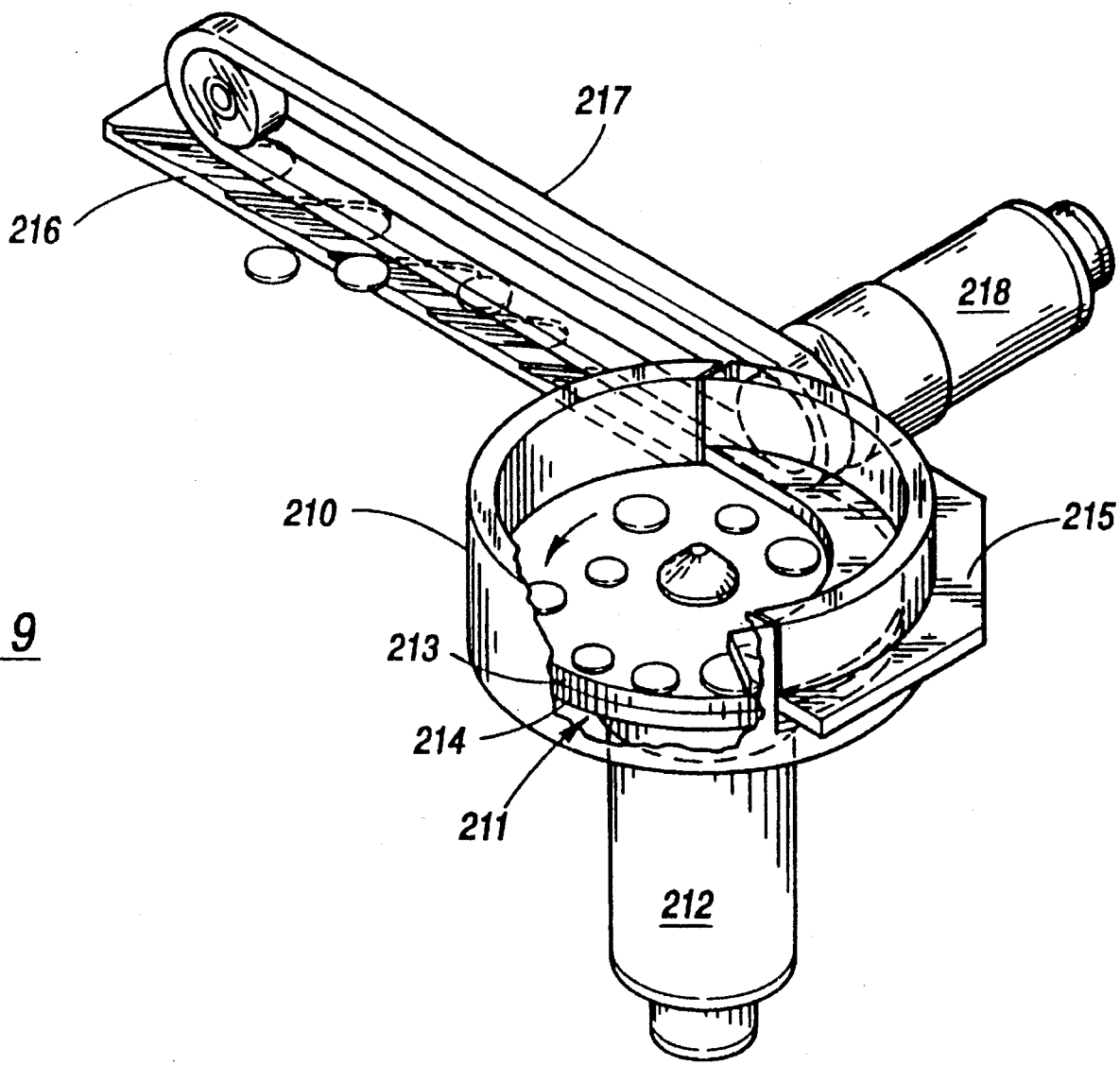
FIG. 9 is perspective view of a rail-type coin sorter embodying the present invention, with portions thereof broken away to show the internal structure.

Referring first to FIG. 9, a hollow cylinder 210 receives coins of mixed denominations and feeds them onto the top surface of a rotatable disc 211 mounted for rotation on the output shaft (not shown) of an electric motor 212. The disc 211 comprises a resilient pad 213, preferably made of a resilient rubber or polymeric material, bonded to the top surface of a solid metal plate 214.

As the disc 211 is rotated, the coins deposited on the top surface thereof tend to slide outwardly over the surface of the pad 213 due to centrifugal force. As the coins move outwardly, they engage either the inside wall of the cylinder 210 or a queuing head 215 mounted over a peripheral portion of the disc 211 from about the 8 o'clock position to about the 1 o'clock position (see FIG. 10).

The queuing head 215 delivers a single layer of coins in a single file to a coin-guiding member in the form of a sorting rail 216 (FIG. 9). The sorting rail 216 sorts the coins by size. A coin-driving member in the form of a drive belt 217, driven by an electric motor 218, drives the coins along the sorting rail 216.

As the disc 211 is rotated (in the clockwise direction as viewed in FIG. 10), coins adjacent the cylinder 210 are carried into engagement with the entry end 220 of the queuing head 215. Coins can be rotated beneath the queuing head by entering a channel 221 having converging inner and outer walls 222 and 223. The inner wall 222 spirals outwardly (relative to the center of the disc 211) to about the 12 o'clock position, and then continues along a straight tangential line which crosses the periphery of the disc 211 at about the 1 o'clock position. The outer wall 223 has a constant radius from about 8 o'clock to about 9 o'clock, then spirals inwardly from 9 o'clock to about 11 o'clock to form a channel with converging walls in that region of the queuing head. Beyond the 11 o'clock position, the outer wall 223 parallels the inner wall 222, thereby forming a channel of constant width.

The lowermost surface 224 of the queuing head 215 is preferably spaced from the top surface of the pad 213 by only a few thousandths of an inch, so that coins cannot escape from the channel 221 by passing beneath the outer wall 222, and so that coins cannot enter the channel 221 from the inner periphery 225 of the head 215.

Figure 10:
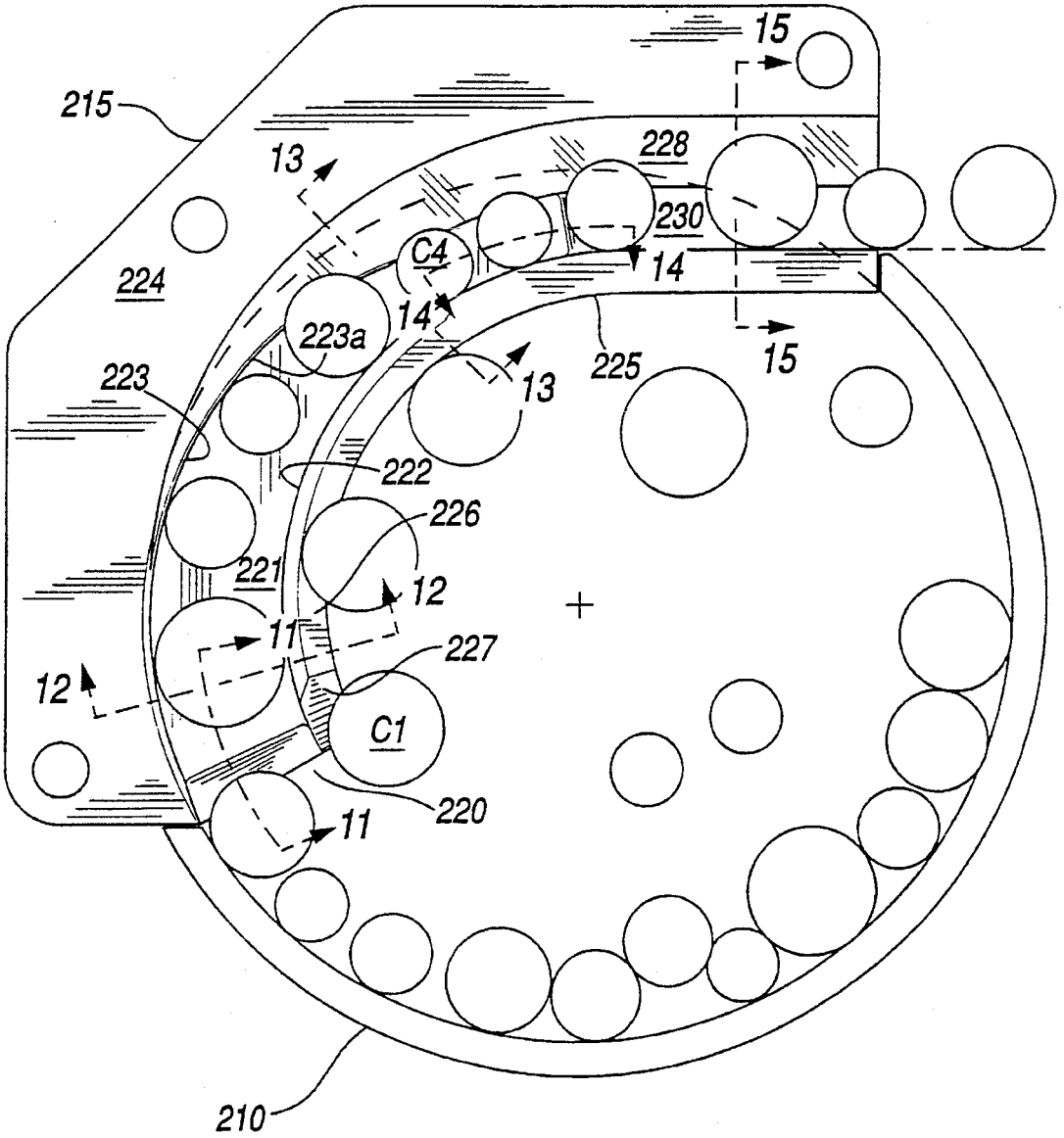
FIG. 10 is an enlarged plan view of the coin-queuing portion of the coin sorter of FIG. 9, taken from the top surface of the rotating pad looking upwardly, with various coins superimposed thereon.

The lowermost surface 224 of the queuing head 215 forms a land 226 along the entire inner edge of the head. The upstream end of the land 226 forms a ramp 227 which presses any coin brought into engagement therewith downwardly into the resilient pad 213, which causes the engaged coin to be recirculated. More specifically, coins which are pressed down into the pad 213 by the ramp 227, such as the coin C1 in FIG. 10, are carried along a path of constant radius beneath the land 226, while the inner edge of the head 215 spirals outwardly from the center of the disc 211. Eventually, therefore, the coin is rotated clear of the inner edge of the head 215 and is then free to move outwardly against the cylinder 211 and to be recirculated to the entry end 220 of the head 215.

The channel 221 causes all coins which enter the channel, regardless of different thicknesses and/or diameters, to exit the channel with a common edge (the inner edges of all coins in FIGS. 9–16) aligned at the same position so that the opposite (outer) edges of the coins can be used for sorting. As can be seen in FIG. 10, the tangential portion of the inner wall 222 at the exit end of the queuing head 215 forms the final gaging wall for the inner edges of the coins as the coins exit the queuing head.

A major portion of the inwardly spiraling portion of the wall 223 is tapered, as at 223*a*, to enable the outer portions of the coins to pass under that wall as the channel 221 converges to a width that is smaller than the diameters of the respective coins. The region 228 immediately outboard of the wall 223 presses the portions of all coins extending outwardly beyond the wall 223 down into the resilient pad 213, thereby tilting the inner edges of the coins upwardly into firm engagement with the gaging wall 222 (FIGS. 11–15).

At about the 12 o'clock position, as viewed in FIG. 10, the walls 222 and 223 both extend along lines which are tangents to the arcs defining the respective walls just before the 12 o'clock position. These tangential walls guide the coins off the disc 211 to the desired coin-receiving device such as a coin-sorting or coin-wrapping mechanism. To ensure stability of the coins as they leave the rotating disc 211, the depth of the channel between the walls 222 and 223 is reduced at 230 so that the tangential portion of that channel (beyond the 12 o'clock position) is shallower than the thickness of the thinnest coin. Consequently, the coins of all denominations are pressed firmly into the resilient pad 213 as the coins leave the disc.

The sorting rail 216 and the drive belt 217 are shown in more detail in FIGS. 16–19. The sorting rail 216 comprises an elongated plate which forms a series of coin exit channels 251, 252, 253, 254, 255 and 256 which function to discharge coins of different denominations at different locations along the length of the plate. The top surface of the sorting rail 216 receives and supports the coins as they are discharged from the disc 211. Because the coins are pressed into the resilient surface of the disc 211, the top surface of the sorting rail 216 is positioned below the lowest coin-engaging surface of the head 215, at the exit end thereof, by about the thickness of the thickest coin. If desired, the entry end of the sorting rail 216 may be tapered slightly to facilitate the transfer of coins from the disc 211 to the sorting rail 216.

Figure 16:
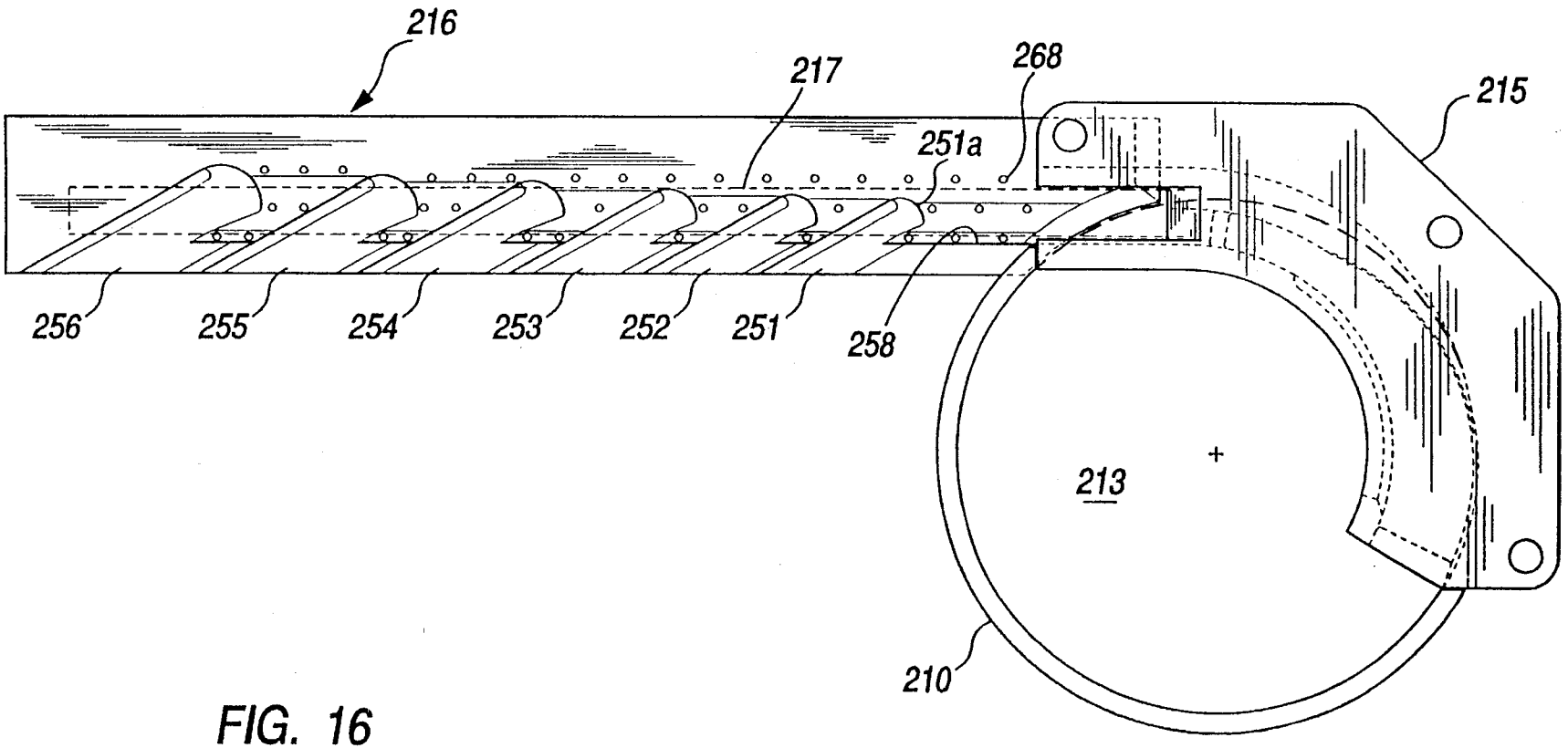
FIG. 16 is a top plan view of the coin sorter of FIG. 9.

The coins are advanced along the sorting rail 216 by a drive belt 217 which presses the coins down against the sorting rail 216. As can be seen in FIG. 16, the exit end of the head 215 is cut out to allow the belt 217 to engage the upper surfaces of the coins even before they leave the disc 211. The aligned edges of the coins follow a gaging wall 258 which is a continuation of the wall 222 in the queuing head 215 and is interrupted only by the exit channels 251–256. The side walls of the exit channels 251–256 intersect the gaging wail 258 at oblique angles so that the driving force of the belt 217 on the upper surfaces of the coins drives the coins outwardly through their respective exit channels 251–256.

To prevent the coins from galling the surface of the sorting rail 216 as they are advanced along the rail 216 by the drive belt 217, the rail 216 is provided with lubricant-filled cavities 268 akin to the lubricant-filled cavities 99, 146, and 162 in FIGS. 2 and 6. As the coins pass over these cavities 268, the coins drag minute amounts of lubricant from the cavities 268 and distribute a portion of this lubricant across the surface of the sorting rail 216. The end result is a significant reduction in the coefficient of friction between the coins and the surface of the sorting rail 216. In an alternative embodiment of the sorting rail 216, the lubricant-filled cavities 268 are substituted with a radially-overlapping pair of self-lubricating inserts 268' (FIG. 23) akin to the inserts 99', 146', and 162' in FIGS. 21 and 22.

The drive belt 217 has a resilient outer surface 259 (FIG. 19) which is positioned close enough to the top surface of the sorting rail 216 to press ail the coins firmly against the sorting rail 216. This capturing of the coins between the belt 217 and the sorting rail 216 holds the coins precisely in the same relative positions established by the queuing device, with the aligned edges of the coins riding along the gaging wail 258. Consequently, the positions of the opposite edges (the upper edges as viewed in FIG. 16) of the coins are uniquely determined by the respective diameters of the coins, so that each denomination of coin will be intercepted by a different exit channel. The resilient surface of the belt 217 ensures that each coin is pressed down into its respective exit channel, and that each coin is exited from the sorting rail 216 by the driving force of the belt 217 urging the coin against the longer (forward) side wail of its exit channel.

The inlet ends of successive exit channels 251–256 are located progressively farther away from the line of the gaging wall 258, thereby receiving and ejecting coins in order of increasing diameter. In the particular embodiment illustrated, the six channels 251–256 are positioned and dimensioned to successively eject the six United States coins in order of increasing size, namely, dimes (channel 251), pennies (channel 252), nickels (channel 253), quarters (channel 254), dollars (channel 255), and half dollars (channel 256). The inlet ends of the exit channels 251–256 are positioned so that only one particular denomination can enter each channel; the coins of all other denominations reaching a given exit channel extend laterally beyond the inlet end of that particular channel so that those coins cannot enter the channel and, therefore, continue on to the next exit channel.

For example, the first exit channel 251 is intended to discharge only dimes, and thus the inlet end 251*a* of this channel is spaced away from the gaging wall 258 by a distance that is only slightly greater than the diameter of a dime. Consequently, only dimes can enter the channel 251. Because one edge of all denominations of coins engages the gaging wall 258, all denominations other than the dime extend beyond the inlet end 251*a* of the channel 251, thereby preventing all coins except the dimes from entering that particular channel.

Of the coins that reach channel 252, only the pennies are of small enough diameter to enter that exit channel. All other denominations extend beyond the inlet end of the channel 252 so that they remain gripped between the sorting rail and the resilient belt. Consequently, such coins are rotated past the channel 252 and continue on to the next exit channel.

Similarly, only nickels can enter the channel 253, only quarters can enter the channel 254, only dollars can enter the channel 255, and only half dollars can enter the channel 256.

In the particular embodiment of the sorting rail 216 shown in FIGS. 16–19, the exit channels 251–256 are narrower at the entry ends than at the exit ends. The change in channel width occurs at the gaging wall 258. The narrowing of the channels at their entry ends provides a wider coin-support area between each pair of adjacent exit channels, which helps prevent undesired tilting of coins as they pass over successive exit channels. Undesired tilting of coins can result in missorting.

Figure 18:
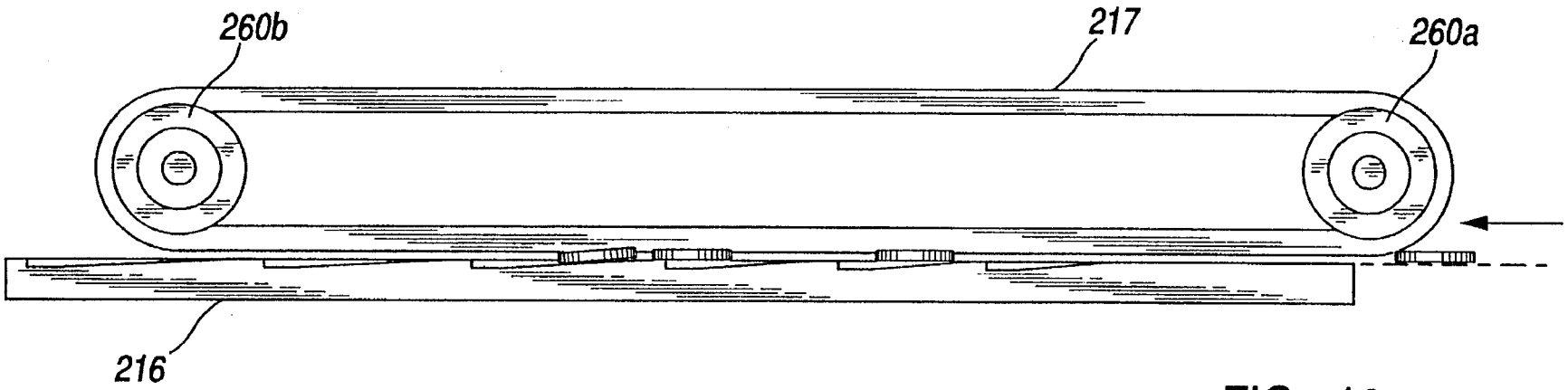
FIG. 18 is a side elevation of the mechanism shown in FIG. 17, with the addition of a drive belt.

As can be seen in FIG. 18, the bottom wall of each of the exit channels 251–256 is tapered across the width of the channel, so that the maximum depth is along the longer, forward side wall of the channel. This tapering of the bottom wall causes the coins to tilt as they are being exited through the channels 251–256, thereby ensuring engagement of each coin with the forward side wail of its respective channel. This further ensures that each coin will remain in the desired exit channel, avoiding missorting.

As shown in FIG. 19, the drive belt 217 preferably has a laminated construction. The inside surface of the belt is made of a layer 217*a* of relatively hard material, forming a toothed surface for positive engagement with both a driven pulley 260*a* and an idler pulley 260b depicted in FIG. 18. The thick central layer 217*b* of the belt is made of a relatively soft, resilient material, such as a closed-cell foam polymer. The outer surface of the belt which engages the coins is formed by a thin layer 217*c* of a tough flexible polymer which can conform to the shapes of the coins (see FIG. 19) and yet withstand the abrasive effect of coins sliding across the belt as they are exited through the channels 251–256.

Figure 17:
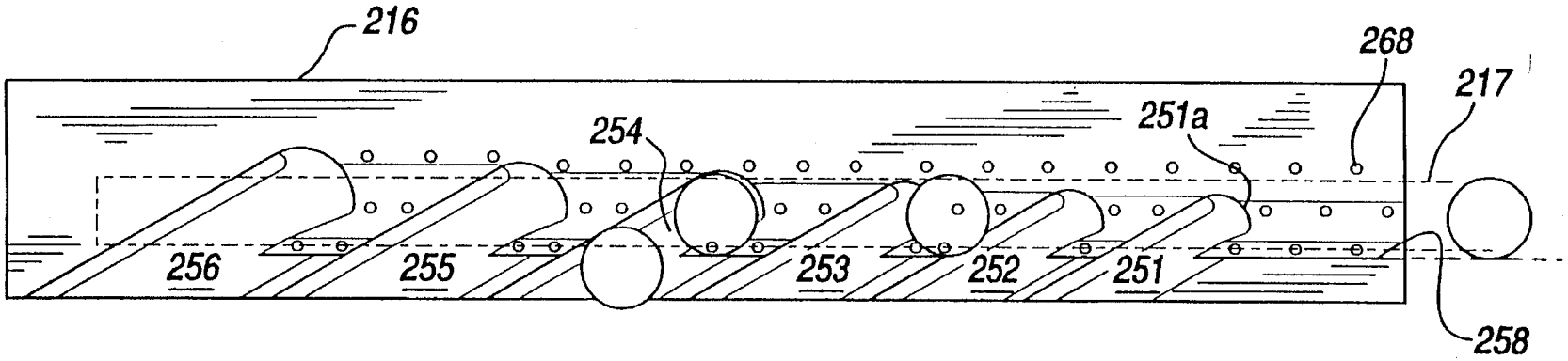
FIG. 17 is an enlarged top plan view of the sorting rail of the device shown in FIG. 16, with various coins superimposed thereon.

The sorting rail 216 in FIG. 17 contains the exit channels 251–256 for discharging coins of different denominations. In an alternative embodiment shown in FIG. 20, the exit channels 251–256 of the sorting rail 216 are substituted with exit apertures 251'–256'. Since the exit apertures 251'–256' sort and discharge coins in similar fashion to the apertures 152*a*–152*h* in FIG. 6, the operation of the apertures 251'–256' is not described in detail herein. It suffices to state that the coins are sorted by passing the coins over the series of apertures 251'–256' formed adjacent to the gaging wall 258'. The apertures 251'–256' are of progressively increasing lateral width so that the small coins are removed before the larger coins. The lower edges of all the apertures 251'–256' (as viewed in FIG. 20) are spaced slightly away from the gaging wall 258' for guiding the lower edges of the coins as the coins are advanced over successive apertures. The rail surface between the gaging wall 258' and the lower edges of the apertures 251'–256' provides a continuous support for the lower portions of the coins. The lower portions of the coins are also supported by the rail 216' until each coin reaches its aperture, at which point the lower edge of the coin tilts downwardly and the coin drops through its aperture.

To prevent the coins from galling the surface of the sorting rail 216', the sorting rail 216' may either be provided with lubricant-filled cavities 270 (FIG. 20) or self-lubricating inserts 270' (FIG. 24).

As described above, the coin handling devices in FIGS. 1–24 include either lubricant-filled cavities or self-lubricating inserts to reduce the coefficient of friction between the coins and the surface of a stationary coin-guiding member of the coin handling device as the coins are moved along the surface by a movable coin-driving member. The coin-driving member has a resilient surface for engaging the coins and driving the engaged coins along the surface of the stationary member. As stated above, the stationary coin-guiding member containing the cavities or inserts varies in accordance with the type of coin handling device manipulating the coins. For example, the disc-type coin sorter in FIGS. 1–4 and 21 includes the stationary sorting head 12, and the coin-driving member for moving coins along the surface of this sorting head 12 is the rotating disc 13. The disc-to-disc type coin sorter in FIGS. 5–8 and 22 includes the stationary queuing head 112, and the coin-driving member for moving coins along the surface of this queuing head 112 is the rotating disc 114. The disc-to-disc type coin sorter in FIGS. 5–8 and 22 further includes the stationary sorting disc 150, and the coin-driving member for moving coins along the surface of this sorting disc 150 is the rotating disc 158 with resilient pad 156: The rail-type coin sorter in FIGS. 9–19 and 23 includes the stationary sorting rail 216, and the coin-driving member for moving coins along the surface of the sorting rail 216 is the drive belt 217. Finally, the modified rail-type coin sorter in FIGS. 20 and 24 includes the stationary sorting rail 216', and the coin-driving member for moving coins along the surface of the sorting rail 216' is the drive belt 217.

In each of the coin handling devices of FIGS. 1–20, the lubricant-filled cavities are preferably disposed in one or more regions where the stationary coin-guiding member presses the coins into the resilient surface of the coin-driving member. Moreover, the lubricant-filled cavities are strategically positioned in the coin-guiding member at locations targeting the inner and outer edges of the various coins moving along the surface of the stationary coin-guiding member. In the alternative coin handling devices of FIGS. 21–24, the self-lubricating inserts are preferably disposed at one or more locations just upstream from high pressure regions. At each location one or more elongated inserts are positioned to target the inner and outer edges of the various coins moving along the surface of the stationary coin-guiding member. The lubricant-filled cavities and the self-lubricating inserts effectively reduce the friction between the coins and the stationary coin-guiding member as the resilient surface of the coin-driving member moves the coins along the coin-guiding member. This reduced friction, in turn, minimizes galling of the coin-guiding member.

In an alternative embodiment, the lubricant-filled cavities and the self-lubricating inserts are substituted with a gall-resistant coating applied to the coin-guiding surface of the coin-guiding member. In particular, the gall-resistant coating is applied to the lower surface of the stationary sorting head 12 of the disc-type coin sorter in FIGS. 1–4 and 21. Similarly, the coating is applied to the lower surface of the stationary queuing head 112 and to the upper surface of the stationary sorting disc 150 of the disc-to-disc type coin sorter in FIGS. 5–8 and 22. Finally, the coating is applied to the upper surface of the sorting rails 216 and 216' of the rail-type coin sorters in FIGS. 9–20, 23, and 24.

In one embodiment, the gall-resistant coating is a solid film lubricant which lubricates effectively over the operating temperature range of the coin handling devices. The solid film lubricant should have superior chip resistance and wear life and should have a low coefficient of friction. A "solid film lubricant" is defined herein as a thin film of resin which binds solid lubricating particles to a surface. In connection with the coin handling devices in FIGS. 1–24, the lubricating particles are bound to the surfaces of the coin-guiding members. These lubricating particles then prevent surface-to-surface contact between the coins and the coin-guiding members and thus reduce friction and wear between these surfaces.

In the preferred embodiment, the solid film lubricant is EVERLUBE® 6111 solid film lubricant produced by E/M Corporation of West Lafayette, Ind. The EVERLUBE® 6111 lubricant has a pencil hardness of 4H (ASTM D-3363) and a coefficient of friction of 0.06. This solid film lubricant uses an epoxy binder to bind polytetrafluoroethane (PTFE) and molybdenum disulfide lubricants to the surface of the coin-guiding members of the various coin handling devices in FIGS. 1–24. The solid film lubricant may be applied to the coin-guiding members by spraying, dipping, brushing, spray/tumbling, or dip/tumbling. The lubricant achieves optimum wear properties when applied to a total thickness between 0.0002 and 0.0005 inches.

In another embodiment, the gall-resistant coating is formed on the surface of the coin-guiding members by subjecting the coin-guiding members to NITROTEC™ surface treatments performed by Ipsen Commercial Heat Treating of Rockford, Ill. The coin-guiding members are gaseous nitrocarburized, polished, and then oxidized to yield a surface with a low coefficient of friction and long wear life. The NITROTEC™ process is described in detail in European Patent No. 0077627 entitled Corrosion Resistant Steel Components and Method of Manufacture, published Apr. 27, 1983, and incorporated herein by reference.

While the present invention has been described with reference to one or more particular embodiments, those skilled in the art will recognize that many changes may be made thereto without departing from the spirit and scope of the present invention. For example, the lubricant-filled cavities, the self-lubricating inserts, and the gall-resistant coating may be used in combination with each other in situations where the galling problem is particularly prevalent. Each of these embodiments and obvious variations thereof is contemplated as falling within the spirit and scope of the claimed invention, which is set forth in the following claims.

What is claimed is:

1. A coin handling device for handling a plurality of coins, comprising:

a coin-driving member having a resilient surface; and a stationary coin-guiding member having a coin-guiding surface opposing the resilient surface of the coin-driving member, the coin-guiding surface being positioned generally parallel to the resilient surface and spaced slightly therefrom, the resilient surface of the coin-driving member constructed and arranged to move the coins along the coin-guiding surface of the coin-guiding member, the coin-guiding member including means for lubricating the coin-guiding surface of the coin-guiding member so as to reduce friction between the coins and the coin-guiding surface.

2. The coin handling device of claim 1, wherein the lubricating means includes a gall-resistant coating applied to the coin-guiding surface of the coin-guiding member.

3. The coin handling device of claim 2, wherein the gall-resistant coating includes a solid film lubricant.

4. The coin handling device of claim 3, wherein the solid film lubricant is composed of an epoxy resin binder, polytetrafluoroethane (PTFE), and molybdenum disulfide.

5. The coin handling device of claim 2, wherein the gall-resistant coating is formed on the coin-guiding surface by nitrocarburizing, polishing, and oxidizing the coin-guiding surface.

6. The coin handling device of claim 1, wherein the lubricating means includes a plurality of spaced cavities formed in the coin-guiding surface of the coin-guiding member, the cavities being at least partially filled with solid lubricant.

7. The coin handling device of claim 6, wherein said cavities are located in regions where the coin-guiding member presses the coins into the resilient surface of the coin-driving member.

8. The coin handling device of claim 1, wherein the lubricating means includes at least one self-lubricating insert secured in a cavity formed in the coin-guiding surface of the coin-guiding member.

9. The coin handling device of claim 8, wherein the self-lubricating insert is composed of a graphite-loaded polyimide resin.

10. The coin handling device of claim 1, wherein the coin-driving member includes a rotatable disc and the coin-guiding member includes a sorting plate.

11. The coin handling device of claim 10, wherein the coin-guiding surface of the sorting plate forms a queuing region for aligning edges of the coins at a common radius and a periphery of the coin-guiding surface forms a plurality of exit channels for selectively allowing exiting of the queued coins based upon their respective diameters.

12. The coin handling device of claim 10, wherein a periphery of the coin-guiding surface of the sorting plate forms a plurality of exit apertures for selectively allowing exiting of the coins based upon their respective diameters.

13. The coin handling device of claim 1, wherein the coin-driving member includes a rotatable disc and the coin-guiding member includes a queuing head for aligning edges of the coins on the coin-guiding surface of the queuing head.

14. The coin handling device of claim 1, wherein the coin-driving member includes a drive belt and the coin-guiding member includes a sorting rail.

15. The coin handling device of claim 14, wherein the coin-guiding surface of the sorting rail forms a plurality of exit channels for selectively allowing exiting of the coins based upon their respective diameters.

16. The coin handling device of claim 14, wherein the coin-guiding surface of the sorting rail forms a plurality of exit apertures for selectively allowing exiting of the coins based upon their respective diameters.

17. A disc-type coin sorter, comprising:

a rotatable disc having a resilient top surface for receiving a plurality of coins thereon; and a stationary sorting head having a lower surface being positioned generally parallel to the resilient top surface of the disc and spaced slightly therefrom, the lower surface of the sorting head having formed therein a queuing region for aligning edges of the coins on the top surface of the disc at a common radius, a periphery of the lower surface of the sorting head forming a plurality of exit stations for selectively allowing exiting of the queued coins based upon their respective diameters, the sorting head including at least one self-lubricating insert secured in a cavity formed in the lower surface of the sorting head so as to reduce friction between the coins and the lower surface of the sorting head.

18. The coin sorter of claim 17, wherein the self-lubricating insert is composed of a graphite-loaded plastic resin.

19. The coin sorter of claim 18, wherein the plastic resin contains a polyimide.

20. A disc-type coin sorter, comprising:

a rotatable disc having a resilient top surface for receiving a plurality of coins thereon; and a stationary sorting head having a lower surface being positioned generally parallel to the resilient top surface of the disc and spaced slightly therefrom, the lower surface of the sorting head having formed therein a queuing region for aligning edges of the coins on the top surface of the disc at a common radius, a periphery of the lower surface of the sorting head forming a plurality of exit stations for selectively allowing exiting of the queued coins based upon their respective diameters, the sorting head including a gall-resistant coating applied to the lower surface of the sorting head so as to reduce friction between the coins and the lower surface of the sorting head.

21. The coin handling device of claim 20, wherein the gall-resistant coating includes a solid film lubricant.

22. The coin handling device of claim 21, wherein the solid film lubricant is composed of an epoxy resin binder, polytetrafluoroethane (PTFE), and molybdenum disulfide.

23. The coin handling device of claim 20, wherein the gall-resistant mating is formed on the coin-guiding surface by nitrocarburizing, polishing, and oxidizing the coin-guiding surface.

24. A stationary sorting head for a disc-type coin sorter including a rotatable disc, the rotatable disc having a resilient top surface for receiving a plurality of coins thereon, the sorting head comprising:

a lower surface being positioned generally parallel to the resilient top surface of the disc and spaced slightly therefrom, the lower surface of the sorting head having formed therein a queuing region for aligning edges of the coins on the top surface of the disc at a common radius, a periphery of the lower surface of the sorting head forming a plurality of exit stations for selectively allowing exiting of the queued coins based upon their respective diameters, at least one self-lubricating insert being secured in a cavity formed in the lower surface of the sorting head so as to reduce friction between the coins and the lower surface of the sorting head.

25. A stationary sorting head for a disc-type coin sorter including a rotatable disc, the rotatable disc having a resilient top surface for receiving a plurality of coins thereon, the sorting head comprising:

a lower surface being positioned generally parallel to the resilient top surface of the disc and spaced slightly therefrom, the lower surface of the sorting head having formed therein a queuing region for aligning edges of the coins on the top surface of the disc at a common radius, a periphery of the lower surface of the sorting head forming a plurality of exit stations for selectively allowing exiting of the queued coins based upon their respective diameters, a gall-resistant coating being applied to the lower surface of the sorting head so as to reduce friction between the coins and the lower surface of the sorting head.

26. A method for handling coins in a coin handling device including a coin-driving member having a resilient surface and a stationary coin-guiding member having a coin-guiding surface opposing the resilient surface of the coin-driving member, the coin-guiding surface being positioned generally parallel to the resilient surface and spaced slightly therefrom, the method comprising the steps of:

providing the coin-guiding member with means for lubricating the coin-guiding surface of the coin-guiding member so as to reduce friction between the coins and the coin-guiding surface;

receiving a plurality of coins between the resilient surface of the coin-driving member and the coin-guiding surface of the coin-guiding member; and activating the coin-driving member such that the resilient surface of the coin-driving member moves the coins along the coin-guiding surface of the coin-guiding member.

27. The method of claim 26, wherein the step of providing the coin-guiding member with the lubricating means includes applying a gall-resistant coating to the coin-guiding surface of the coin-guiding member.

28. The method of claim 27, wherein the gall-resistant coating includes a solid film lubricant.

29. The method of claim 28, wherein the solid film lubricant is composed of an epoxy resin binder, polytetrafluoroethane (PTFE), and molybdenum disulfide.

30. The method of claim 27, wherein the step of applying the gall-resistant coating includes nitrocarburizing, polishing, and oxidizing the coin-guiding surface.

31. The method of claim 26, wherein the step of providing the coin-guiding member with the lubricating means includes forming a plurality of spaced cavities in the coin-guiding surface of the coin-guiding member and at least partially filling these cavities with solid lubricant.

32. The method of claim 26, wherein the step of providing the coin-guiding member with the lubricating means includes forming a cavity in the coin-guiding surface of the coin-guiding member and securing a self-lubricating insert in the cavity.

* * * * *